US010631102B2

(12) United States Patent
Jensen et al.

(10) Patent No.: US 10,631,102 B2
(45) **Date of Patent: *Apr. 21, 2020**

(54) MICROPHONE SYSTEM AND A HEARING DEVICE COMPRISING A MICROPHONE SYSTEM

(71) Applicant: Oticon A/S, Smørum (DK)

(72) Inventors: Jesper Jensen, Smørum (DK); Jan Mark De Haan, Smørum (DK); Michael Syskind Pedersen, Smørum (DK)

(73) Assignee: OTICON A/S, Smørum (DE)

( * ) Notice: Subject to any disclaimer, the term of this patent is extended or adjusted under 35 U.S.C. 154(b) by 5 days.

This patent is subject to a terminal disclaimer.

(21) Appl. No.: 16/003,396

(22) Filed: Jun. 8, 2018

(65) Prior Publication Data

US 2018/0359572 A1 Dec. 13, 2018

(30) Foreign Application Priority Data

Jun. 9, 2017 (EP) ..... 17175303

(51) Int. Cl.
*H04R 25/00* (2006.01)
*H04R 1/40* (2006.01)

(52) U.S. Cl.
CPC ..... *H04R 25/407* (2013.01); *H04R 1/406* (2013.01); *H04R 25/405* (2013.01);
(Continued)

(58) Field of Classification Search
CPC .. H04R 25/407; H04R 25/405; H04R 25/554; H04R 25/505; H04R 25/453; H04R 25/552; H04R 1/406; H04R 2420/01
See application file for complete search history.

(56) References Cited

U.S. PATENT DOCUMENTS 9,549,253 B2 * 1/2017 Alexandridis ..... H04R 3/005
10,341,786 B2 * 7/2019 Pedersen ..... H04R 25/43
(Continued)

FOREIGN PATENT DOCUMENTS

EP 2701145 A1 2/2014
EP 2882204 A1 6/2015
(Continued)

OTHER PUBLICATIONS

Farmani et al., "Informed Sound Source Localization Using Relative Transfer Functions for Hearing Aid Applications", IEEE/ACM Transactions on Audio, Speech, and Language Processing, vol. 25, No. 3, Mar. 2017, pp. 611-623.
(Continued)

*Primary Examiner* — Oyesola C Ojo
(74) *Attorney, Agent, or Firm* — Birch, Stewart, Kolasch & Birch, LLP

(57) ABSTRACT

A microphone system comprises a multitude of microphones; a signal processor connected to said number of microphones, and being configured to estimate a direction-to and/or a position of the target sound source relative to the microphone system based on a maximum likelihood methodology; and a database Θ comprising a dictionary of relative transfer functions representing direction-dependent acoustic transfer functions from said target signal source to each of said microphones relative to a reference microphone among said microphones, wherein individual dictionary elements of said database Θ of relative transfer functions comprises relative transfer functions for a number of different directions and/or positions relative to the microphone system; and wherein the signal processor is configured to determine one or more of the most likely directions to or locations of said target sound source. The invention may e.g.
(Continued)

be used for the hearing aids or other portable audio communication devices.

23 Claims, 12 Drawing Sheets

(52) U.S. Cl.
CPC ..... *H04R 25/453* (2013.01); *H04R 25/505* (2013.01); *H04R 25/552* (2013.01); *H04R 25/554* (2013.01); *H04R 2420/01* (2013.01)

(56) References Cited

U.S. PATENT DOCUMENTS

2004/0220800 A1* 11/2004 Kong ..... G10L 21/0208 704/205
2006/0075422 A1* 4/2006 Choi ..... G01S 3/7864 725/18
2007/0016267 A1* 1/2007 Griffin ..... A61N 1/36038 607/57
2015/0163602 A1* 6/2015 Pedersen ..... H04R 25/30 381/315
2015/0213811 A1* 7/2015 Elko ..... H04R 3/005 381/92
2015/0289064 A1* 10/2015 Jensen ..... H04R 25/30 381/317
2016/0112811 A1* 4/2016 Jensen ..... H04R 5/033 381/17

FOREIGN PATENT DOCUMENTS

EP 3013070 A2 4/2016
EP 3013070 A3 6/2016
EP 3185590 A1 6/2017
EP 3253075 A1 12/2017
EP 3300078 A1 3/2018

OTHER PUBLICATIONS

Ye et al., "Maximum Likelihood DOA Estimation and Asymptotic Cramér-Rao Bounds for Additive Unknown Colored Noise," IEEE Transactions on Signal Processiong, vol. 43, No. 4, Apr. 1995, pp. 938-949.

* cited by examiner

MICROPHONE SYSTEM AND A HEARING DEVICE COMPRISING A MICROPHONE SYSTEM

SUMMARY

The present disclosure relates to a microphone system (e.g. comprising a microphone array), e.g. forming part of a hearing device, e.g. a hearing aid, or a hearing system, e.g. a binaural hearing aid system, configured to use a maximum likelihood (ML) based method for estimating a direction-of-arrival (DOA) of a target signal from a target sound source in a noisy background. The method is based on the assumption that a dictionary of relative transfer functions (RTFs), i.e., acoustic transfer functions from a target signal source to any microphones in the hearing aid system relative to a reference microphone, is available. Basically, the proposed scheme aims at finding the RTF in the dictionary which, with highest likelihood (among the dictionary entries), was "used" in creating the observed (noisy) target signal.

This dictionary element may then be used for beamforming purposes (the relative transfer function is an element of most beamformers, e.g. an MVDR beamformer). Additionally, since each RTF dictionary element has a corresponding DOA attached to it, an estimate of the DOA is thereby provided. Finally, using parts of the likelihood computations, it is a simple matter to estimate the signal-to-noise ratio (SNR) of the hypothesized target signal. This SNR may e.g. be used for voice activity detection.

The dictionary Θ may then—for individual microphones of the microphone system comprise corresponding values of location of or direction to a sound source (e.g. indicated by horizontal angle θ), and relative transfer functions RTF at different frequencies (RTF(k,θ), k representing frequency) from the sound source at that location to the microphone in question. The proposed scheme calculates likelihoods for a sub-set of, or all, relative transfer functions (and thus locations/directions) and microphones and points to the location/direction having largest (e.g. maximum) likelihood.

The microphone system may e.g. constitute or form part of a hearing device, e.g. a hearing aid, adapted to be located in and/or at an ear of a user. In an aspect, a hearing system comprising left and right hearing devices, each comprising a microphone system according to the present disclosure is provided. In an embodiment, the left and right hearing devices (e.g. hearing aids) are configured to be located in and/or at left and right ears, respectively, of a user.

A Microphone System:

In an aspect of the present application, a microphone system is provided. The microphone system comprises a multitude of M of microphones, where M is larger than or equal to two, adapted for picking up sound from the environment and to provide M corresponding electric input signals $x_m(n)$, m=1, . . . , M, n representing time, the environment sound at a given microphone comprising a mixture of a target sound signal $s_m(n)$ propagated via an acoustic propagation channel from a location of a target sound source, and possible additive noise signals $v_m(n)$ as present at the location of the microphone in question;

a signal processor connected to said number of microphones, and being configured to estimate a direction- to and/or a position of the target sound source relative to the microphone system based on a maximum likelihood methodology;

a database Θ comprising a dictionary of relative transfer functions $d_m(k)$ representing direction-dependent acoustic transfer functions from each of said M microphones (m=1, . . . , M) to a reference microphone (m=i) among said M microphones, k being a frequency index.

The individual dictionary elements of said database Θ of relative transfer functions $d_m(k)$ comprises relative transfer functions for a number of different directions (θ) and/or positions (θ, φ, r) relative to the microphone system (where θ, φ, and r are spherical coordinates; other spatial representations may be used, though). The signal processor is configured to determine a posterior probability or a log (posterior) probability of some of or all of said individual dictionary elements, determine one or more of the most likely directions to or locations of said target sound source by determining the one or more values among said determined posterior probability or said log (posterior) probability having the largest posterior probability(ies) or log (posterior) probability(ies), respectively.

Thereby an improved microphone system may be provided.

In an embodiment, the individual dictionary elements are selected or calculated based on a calibration procedure, e.g. based on a model.

Embodiments of the microphone system may have one or more of the following advantages:

Only physically plausible RTFs can be estimated (the dictionary acts as prior knowledge of possible RTF outcomes).

With the proposed ML method, it is a simple matter to impose a constraint, e.g. that all RTFs across frequency should "point towards" the same physical object, e.g. that they should all correspond to the same DOA. Similarly, it is easy (and computationally simple) to constrain the RTFs estimated at different locations (e.g. ears) to "point" in the same direction.

Own voice: if used for beamforming in body worn microphone arrays, fewer own voice problems are expected, since the microphone system may be configured to provide that the RTF corresponding to the mouth position does not form part of the dictionary. Alternatively, if the RTF dictionary was extended with the RTF corresponding to the mouth position, this could be used for own voice detection.

The term 'posterior probability' is in the present context taken to mean a conditional probability, e.g. a probability of a direction-of-arrival θ, given a certain evidence X (e.g. given a certain input signal X(l) at a given time instant l). This conditional (or posterior) probability is typically written p(θ|X). The term 'prior probability distribution', sometimes denoted the 'prior', is in the present context taken to relate to a prior knowledge or expectation of a distribution of a parameter (e.g. of a direction-of-arrival) before observed data are considered.

In an embodiment, n represents a time frame index.

The signal processor may be configured to determine a likelihood function or a log likelihood function of some or all of the elements in the dictionary Θ in dependence of a noisy target signal covariance matrix $C_x$ and a noise covariance matrix $C_v$ (two covariance matrices). In an embodiment, the noisy target signal covariance matrix $C_x$ and the noise covariance matrix $C_v$ are estimated and updated based on a voice activity estimate and/or an SNR estimate, e.g. on a frame by frame basis. The noisy target signal covariance matrix $C_x$ and the noise covariance matrix $C_v$ may be represented by smoothed estimates. The smoothed estimates of the noisy covariance matrix $\hat{C}_X$ and/or the noise covariance matrix $\hat{C}_V$ may be determined by adaptive covariance smoothing. The adaptive covariance smoothing comprises determining normalized fast and variable covariance measures, $\tilde{\rho}(m)$ and an $\bar{\rho}(m)$, respectively, of estimates of said noisy covariance matrix $\hat{C}_X$ and/or said noise covariance matrix $\hat{C}_V$, applying a fast ($\tilde{\alpha}$) and a variable smoothing factor ($\bar{\alpha}$), respectively, wherein said variable smoothing factor $\bar{\alpha}$ is set to fast (˜) when the normalized covariance measure of the variable estimator deviates from the normalized covariance measure of the variable estimator by more than a constant value $\epsilon$, and otherwise to slow ($\alpha_0$), i.e.

$$\bar{\alpha}(m) = \begin{cases} \alpha_0, & |\tilde{\rho}(m) - \bar{\rho}(m)| \leqq \epsilon \\ \tilde{\alpha}, & |\tilde{\rho}(m) - \bar{\rho}(m)| > \epsilon \end{cases}$$

where m is a time index, and where $\alpha_0 < \tilde{\alpha}$. (see e.g. section 'Adaptive smoothing' and FIGS. 13A, 13B and 13C below).

In an embodiment, the microphone system is adapted to be portable, e.g. wearable.

In an embodiment, the microphone system is adapted to be worn at an ear of a user, and wherein said relative transfer functions $d_m(k)$ of the database $\Theta$ represent direction-dependent filtering effects of the head and torso of the user in the form of direction-dependent acoustic transfer functions from said target signal source to each of said M microphones (m=1, . . . , M) relative to a reference microphone (m=i) among said M microphones.

In an embodiment, the signal processor is additionally configured to estimate a direction- to and/or a position of the target sound signal relative to the microphone system based on a signal model for a received sound signal $x_m$ at microphone m (m=1, . . . , M) through the acoustic propagation channel from the target sound source to the $m^{th}$ microphone. In an embodiment, the signal model assumes that the target signal $s_m(n)$ impinging on the $m^{th}$ microphone is contaminated by additive noise $v_m(n)$, so that the noisy observation $x_m(n)$ is given by $$x_m(n)=s_m(n)+v_m(n);\ m=1, \ldots ,M;$$

where $x_m(n)$, $s_m(n)$, and $v_m(n)$ denote the noisy target signal, the clean target signal, and the noise signal, respectively, M>1 is the number of available microphones, and n is a discrete-time index. For mathematical convenience, it is assumed that the observations are realizations of zero-mean Gaussian random processes, and that the noise process is statistical independent of the target process.

In an embodiment, the number of microphones M is equal to two, and wherein the signal processor is configured to calculate a log likelihood of at least some of said individual dictionary elements of said database $\Theta$ of relative transfer functions $d_m(k)$ for at least one frequency sub-band k, according to the following expression $$\mathcal{L}_{\theta,M=2}(l) \propto -\log\left\{\frac{w_\theta^H(l)\hat{C}_X(l)w_\theta(l)}{w_\theta^H(l)\hat{C}_V(l_0)w_\theta(l)} \times \frac{b_\theta^H\hat{C}_X(l)b_\theta}{b_\theta^H\hat{C}_V(l_0)b_\theta} \times |C_V(l_0)|\right\},$$

where l is a time frame index, $w_\theta$ represents, possibly scaled, MVDR beamformer weights, $\hat{C}_X$ and $\hat{C}_V$ are smoothed estimates of the noisy covariance matrix and the noise covariance matrix, respectively, $b_\theta$ represents beamformer weights of a blocking matrix, and $l_0$ denotes the last frame, where $\hat{C}_V$ has been updated. Thereby the DOA can be efficiently estimated.

In an embodiment, the smoothed estimates of said noisy covariance matrix $\hat{C}_X$ and/or said noise covariance matrix $\hat{C}_V$, are determined depending on an estimated signal to noise ratio. In an embodiment, one or more smoothing time constants are determined depending on an estimated signal to noise ratio.

In an embodiment, the smoothed estimates of said noisy covariance matrix $\hat{C}_X$ and/or said noise covariance matrix $\hat{C}_V$, are determined by adaptive covariance smoothing.

In an embodiment, the microphone system comprises a voice activity detector configured to estimate whether or with what probability an electric input signal comprises voice elements at a given point in time. In an embodiment, the voice activity detector is configured to operate in a number of frequency sub-bands and to estimate whether or with what probability an electric input signal comprises voice elements at a given point in time in each of said number of frequency sub-bands. In an embodiment, the microphone system, e.g. the signal processor, is configured to calculate or update the inter microphone covariance matrices $C_x$ and $C_V$ in separate time frames in dependence of a classification of a presence or absence of speech in the electric input signals.

In an embodiment, the voice activity detector is configured to provide a classification of an input signal according to its target signal to noise ratio in a number of classes, where the target signal represents a voice, and where the number of classes is three or more and comprises a High SNR, a Medium SNR, and a Low SNR class. It is to be understood that the signal to noise ratios (SNR(t)) of an electric input signal that at given points in time $t_1$, $t_2$, and $t_3$ is classified as High SNR, Medium SNR, and Low SNR, respectively, are related so that $SNR(t_1)>SNR(t_2)>SNR(t_3)$. In an embodiment, the signal processor is configured to calculate or update the inter microphone covariance matrices $C_X$ and $C_V$ in separate time frames in dependence of said classification. In an embodiment, the signal processor is configured to calculate or update the inter microphone covariance matrix $C_X$ for a given frame and only when the voice activity detector classifies the current electric input signal as High SNR. In an embodiment, the signal processor is configured to calculate or update the inter microphone covariance matrix $C_V$ only when the voice activity detector classifies the current electric input signal as Low SNR.

In an embodiment, the dictionary size (or prior probability) is changed as a function of input sound level or SNR, e.g. in that the dictionary elements are limited to cover certain angles $\theta$ for some values of input sound levels or SNR. In an embodiment, at High sound level/low SNR: only dictionary elements in front of listener are included in computations. In an embodiment, at Low input level/high SNR: dictionary elements towards all directions are included in the computations.

In an embodiment, dictionary elements may be selected or calculated based on a calibration signal, e.g. a calibration signal from the front (or own voice). Own voice may be used for calibration as own voice always comes from the same position relative to the hearing instruments.

In an embodiment, the dictionary elements (relative transfer functions and/or the selected locations) are individualized, to a specific user, e.g. measured in advance of use of microphone system, e.g. during a fitting session.

In an embodiment, the DOA estimation is based on a limited frequency bandwidth only, e.g. on a sub-set of frequency bands, e.g. such bands where speech is expected to be present.

In an embodiment, the signal processor is configured to estimate the posterior probability or the log (posterior) probability of said individual dictionary elements $d_\theta$ of said database $\Theta$ comprising relative transfer functions $d_{\theta,m}(k)$, m=1, . . . , M, independently in each frequency band k. In other words, individual dictionary elements $d_\theta$ comprising the relative transfer function $d_{\theta,m}(k)$, are estimated independently in each frequency band leading to possibly different estimated DoAs at different frequencies.

In an embodiment, the signal processor is configured to estimate the posterior probability or the log (posterior) probability of said individual dictionary elements $d_\theta$ of said database $\Theta$ comprising relative transfer functions $d_{\theta m}(k)$, m=1 . . . . , M, jointly across some of or all frequency bands k. In the present context, the terms 'estimated jointly' or 'jointly optimal' are intended to emphasize that individual dictionary elements $d_\theta$ comprising relative transfer functions $d_{\theta,m}(k)$ are estimated across some of or all frequency bands kin the same Maximum Likelihood estimation process. In other words: In an embodiment, the ML estimate of the individual dictionary elements $d_\theta$ is found by choosing the (same) $\theta^{*th}$ RTF vector for each frequency band, where $$\theta^* = \underset{\theta}{\operatorname{argmax}} \sum_k \mathcal{L}_{\theta,k},$$

where $\mathcal{L}_{\theta,k}$ denotes the log-likelihood computed for the $\theta^{th}$ RTF vector $d_\theta$ in frequency band k.

In an embodiment, the signal processor is configured to utilize additional information not derived from said electric input signals—to determine one or more of the most likely directions to or locations of said target sound source.

In an embodiment, the additional information comprises information about eye gaze, and/or information about head position and/or head movement.

In an embodiment, the additional information comprises information stored in the microphone system, or received, e.g. wirelessly received, from another device, e.g. from a sensor, or a microphone, or a cellular telephone, and/or from a user interface.

In an embodiment, the database $\Theta$ of RTF vectors $d_\theta$ comprises an own voice look vector. Thereby the DoA estimation scheme can be used for own voice detection. If e.g. the most likely look vector in the dictionary at a given point in time is the one that corresponds to the location of the user's mouth, it represents an indication that own voice is present.

A Hearing Device, e.g. a Hearing Aid:

In an aspect, a hearing device, e.g. a hearing aid, adapted for being worn at or in an ear of a user, or for being fully or partially implanted in the head at an ear of the user, comprising a microphone system as described above, in the detailed description of the drawings, and in the claims is furthermore provided.

In an embodiment, the hearing device comprises a beamformer filtering unit operationally connected to at least some of said multitude of microphones and configured to receive said electric input signals, and configured to provide a beamformed signal in dependence of said one or more of the most likely directions to or locations of said target sound source estimated by said signal processor. In an embodiment, the hearing device comprises a (single channel) post filter for providing further noise reduction (in addition to the spatial filtering of the beamformer filtering unit), such further noise reduction being e.g. dependent on estimates of SNR of different beam patterns on a time frequency unit scale, cf. e.g. EP2701145A1.

In an embodiment, the signal processor (e.g. the beamformer filtering unit) is configured to calculate beamformer filtering weights based on a beamformer algorithm, e.g. based on a GSC structure, such as an MVDR algorithm. In an embodiment, the signal processor (e.g. the beamformer filtering unit) is configured to calculate sets of beamformer filtering weights (e.g. MVDR weights) for a number (e.g. two or more, e.g. three) of the most likely directions to or locations of said target sound source estimated by the signal processor and to add the beam patterns together to provide a resulting beamformer (which is applied to the electric input signals to provide the beamformed signal).

In an embodiment, the signal processor is configured to smooth said one or more of the most likely directions to or locations of said target sound source before it is used to control the beamformer filtering unit.

In an embodiment, the signal processor is configured to perform said smoothing over one or more of time, frequency and angular direction. In noisy environments, if e.g. SNR is low (e.g. negative), it may be assumed that the user will focus on (e.g. look at) the target sound source and estimation of DoA may (in such case) be concentrated to a limited angle or cone (e.g. in front or to the side or to the rear of the user), e.g. in an angle space spanning +/−30° of the direction in question, e.g. the front of the user. Such selection of focus may be determined in advance or adaptively determined in dependence of one or more sensors, e.g. based on eye gaze, or movement sensors (IMUs), etc.

In an embodiment, the hearing device comprises a feedback detector adapted to provide an estimate of a level of feedback in different frequency bands, and wherein said signal processor is configured to weight said posterior probability or log (posterior) probability for frequency bands in dependence of said level of feedback.

In an embodiment, the hearing device comprises a hearing aid, a headset, an earphone, an ear protection device or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device comprises a microphone system according to the present disclosure adapted to spatially filter sounds from the environment, and thereby enhance a target sound source among a multitude of acoustic sources in the local environment of the user wearing the hearing device. The microphone system is adapted to adaptively detect from which direction a particular part of the microphone signal originates. In hearing devices, a microphone array beamformer is often used for spatially attenuating background noise sources. Many beamformer variants can be found in literature, see, e.g., [Brandstein & Ward; 2001] and the references therein. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation), etc.

In an embodiment, the communication between the hearing device and another device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for f=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping. For DOA estimation, we may base our DOA estimate on a frequency range which is smaller than the bandwidth presented to the listener.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate (s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. compression, noise reduction, feedback detection and/or cancellation, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a microphone system as described above, in the 'detailed description of embodiments' and in the claims, is moreover provided. In an embodiment, use is provided in a hearing device, e.g. a hearing aid. In an embodiment, use is provided in a hearing system comprising one or more hearing aids (e.g. hearing instruments), headsets, ear phones, active ear protection systems, etc. In an embodiment, use is provided in a binaural hearing system, e.g. a binaural hearing aid system.

A Method:

In an aspect, a method of operating a microphone system comprising a multitude of M of microphones, where M is larger than or equal to two, adapted for picking up sound from the environment is furthermore provided by the present application. The method comprises providing M electric input signals $x_m(n)$, m=1, . . . , M, n representing time, each electric input signal representing the environment sound at a given microphone and comprising a mixture of a target sound signal $s_m(n)$ propagated via an acoustic propagation channel from a location of a target sound source, and possible additive noise signals $v_m(n)$ as present at the location of the microphone in question;

estimating a direction- to and/or a position of the target sound source relative to the microphone system based on said electric input signals;

a maximum likelihood methodology; and a database Θ comprising a dictionary of relative transfer functions $d_m(k)$ representing direction-dependent acoustic transfer functions from each of said M microphones (m=1, . . . , M) to a reference microphone (m=i) among said M microphones, k being a frequency index. The method further comprises providing that individual dictionary elements of said database Θ of relative transfer functions $d_m(k)$ comprises relative transfer functions for a number of different directions (θ) and/or positions (θ, φ, r) relative to the microphone system, where θ, φ, and r are spherical coordinates; and determining a posterior probability or a log (posterior) probability of some of or all of said individual dictionary elements, and determining one or more of the most likely directions to or locations of said target sound source by determining the one or more values among said determined posterior probability or said log (posterior) probability having the largest posterior probability(ies) or log (posterior) probability(ies), respectively.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the computational complexity in determining one or more of the most likely directions to or locations of said target sound source is reduced by one or more of dynamically Down sampling, Selecting a subset of the number of dictionary elements, Selecting a subset of the number of frequency channels, and Removing terms in the likelihood function with low importance.

In an embodiment, the DOA estimation is based on a limited frequency bandwidth only, e.g. on a sub-set of frequency bands, e.g. such bands where speech is expected to be present.

In an embodiment, the determination of a posterior probability or a log (posterior) probability of some of or all of said individual dictionary elements is performed in two steps, a first step wherein the posterior probability or the log (posterior) probability is evaluated for a first subset of dictionary elements with a first angular resolution in order to obtain a first rough estimation of the most likely directions, and a second step wherein the posterior probability or the log (posterior) probability is evaluated for a second subset of dictionary elements around said first rough estimation of the most likely directions so that dictionary elements around the first rough estimation of the most likely directions are evaluated with second angular resolution, wherein the second angular resolution is larger than the first.

In the present context, 'evaluated . . . with a larger angular resolution' is intended to mean 'evaluated . . . using a larger number of dictionary elements per radian, (but excluding a part of the angular space away for the first rough estimation of the most likely directions. In an embodiment, the same number of dictionary elements are evaluated in the first and second steps. In an embodiment, the number of dictionary elements evaluated in the second step is smaller than in the first step. In an embodiment, the likelihood values are calculated in several steps, cf. e.g. FIG. 5. In an embodiment, the likelihood calculation steps are aligned between left and right hearing devices of a binaural hearing system.

In an embodiment, the method comprises a smoothing scheme based on adaptive covariance smoothing. Adaptive covariance smoothing may e.g. be advantageous in environments or situations where a direction to a sound source of interest changes (e.g. in that more than one (e.g. localized) sound source of interest is present and where the more than one sound sources are active at different points in time, e.g. one after the other, or un-correlated).

In an embodiment, the method comprises adaptive smoothing of a covariance matrix ($C_x$, $C_v$) for said electric input signals comprising adaptively changing time constants ($\tau_{att}$, $\tau_{rel}$) for said smoothing in dependence of changes (ΔC) over time in covariance of said first and second electric input signals;

wherein said time constants have first values ($\tau_{att}$, $\tau_{rel}$) for changes in covariance below a first threshold value ($\Delta C_{th1}$) and second values ($\tau_{att2}$, $\tau_{rel2}$) for changes in covariance above a second threshold value ($\Delta C_{th2}$), wherein the first values are larger than corresponding second values of said time constants, while said first threshold value ($\Delta C_{th1}$) is smaller than or equal to said second threshold value ($\Delta C_{th2}$).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme). In an embodiment, the smartphone is configured to perform some or all of the processing related to estimating the likelihood function.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device, e.g. a smartphone, is configured to perform some or all of the processing related to estimating the likelihood function and/or the most likely direction(s) of arrival.

In an embodiment, the auxiliary device comprises a further hearing device according to any one of claims 15-20.

In an embodiment, the one or more of the most likely directions to or locations of said target sound source or data related to said most likely directions as determined in one of the hearing devices is communicated to the other hearing device via said communication link and used to determine joint most likely direction(s) to or location(s) of said target sound source. In an embodiment, the joint most likely direction(s) to or location(s) of said target sound source is/are used in one or both hearing devices to control the beamformer filtering unit. In an embodiment, the likelihood values are calculated in several steps, cf. e.g. FIG. 5.

In an embodiment, the likelihood calculation steps are aligned between left and right hearing instruments.

In an embodiment, the hearing system is configured to determine one or more jointly determined most likely directions to or locations of said target sound source by selecting the local likelihood across instruments before adding the likelihoods into joint likelihood across frequency, i.e.

$$\theta^* = \underset{\theta}{\operatorname{argmax}}\left(\sum_k \underset{SNR}{\operatorname{argmax}}(\mathcal{L}_{\theta,left}(k), \mathcal{L}_{\theta,right}(k))\right)$$

where ($\mathcal{L}_{\theta,left}(k)$, $\mathcal{L}_{\theta,right}(k)$) are the likelihood functions, e.g. Log likelihood, estimated locally on left and right hearing instruments, respectively.

In an embodiment, the distribution (e.g. angular distribution, see e.g. FIG. 4A, 4B) of dictionary elements is different on the left and right hearing instruments.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 2A shows a first graphical representation, FIG. 2B shows a second graphical representation, FIG. 2C shows a third graphical representation, FIG. 2D shows a fourth graphical representation, FIG. 2E shows a fifth graphical representation, FIG. 2F shows a sixth graphical representation, and FIG. 2G shows a seventh graphical representation.

FIG. 9B shows a probability distribution of eye gaze angle θ at the given point in time $t_n$, and FIG. 9C shows a dynamic two-talker geometrical setup used for simultaneous estimation of direction of arrival according to the present disclosure and recording of additional information (here eye gaze angle) for use in validation of the estimated direction of arrival according.

The figures are schematic and simplified for clarity, and they just show details which are essential to the understanding of the disclosure, while other details are left out. Throughout, the same reference signs are used for identical or corresponding parts.

Figure 1A:
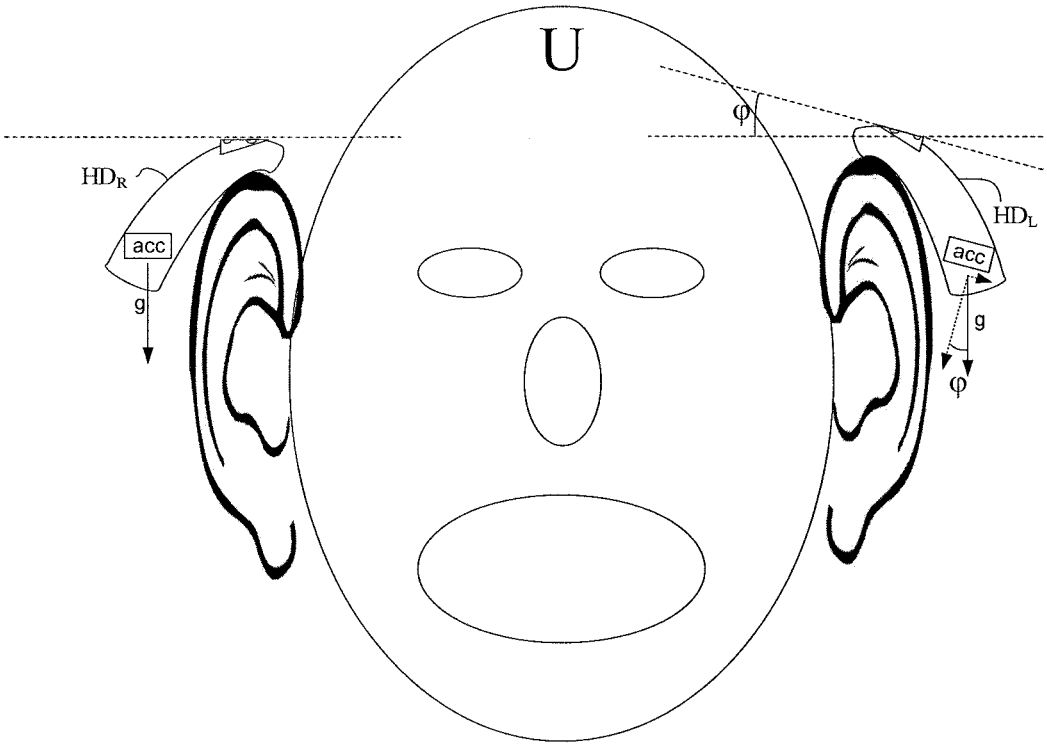
FIG. 1A shows a binaural hearing system comprising left and right hearing devices, which are differently mounted at left and right ears of a user, one hearing device having its microphone axis pointing out of the horizontal plane ($\varphi \neq 0$)

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids. The disclosure deals in particular with a microphone system (e.g. comprising a microphone array) for adaptively estimating a location of or a direction to a target sound.

The assumptions and theoretical framework are outlined in the following.

Signal Model:

It is assumed that the target signal $s_m(n)$ impinging on the $m^{th}$ microphone is contaminated by additive noise $v_m(n)$, so that the noisy observation $x_m(n)$ is given by $$x_m(n)=s_m(n)+v_m(n);\ m=1, \ldots, M;$$

where $x_m(n)$, $s_m(n)$, and $v_m(n)$ denote the noisy target, the clean target, and a noise signal, respectively, where M>1 is the number of available microphones, and n is a discrete-time index. For mathematical convenience (simplicity), it is assumed that the observations are realizations of zero-mean Gaussian random processes, and that the noise process is statistical independent of the target process.

Each microphone signal is passed through an analysis filterbank. For example, if a discrete Fourier Transform (DFT) filterbank is used, the complex-valued sub-band signals (DFT coefficients) are given by $$X_m(l, k) = \sum_{n=0}^{N-1} x_m(n + lD_A)w_A(n)e^{-\frac{2\pi jkn}{N}}$$

where l and k are frame and frequency bin indices, respectively, N is the DFT order, $D_A$ is the filterbank decimation factor, $w_A(n)$ is the analysis window function, potentially including zeroes for zero-padding, and $j=\sqrt{-1}$ is the imaginary unit. Similar expressions hold for target signal DFT coefficients $S_m(l, k)$ and noise DFT coefficients $V_m(l, k)$.

We adopt the standard assumption that $X_m(l, k)$ are approximately independent across time l and frequency k, which allows us to treat DFT coefficients with different frequency index k independently (this assumption is valid when the correlation time of the signal is short compared to the frame length, and successive frames are spaced sufficiently far apart). Therefore, for notational convenience and without loss of generality, the frequency index k is suppressed in the following.

For a given frequency index k and frame index l, noisy DFT coefficients for each microphone are collected in a vector $X(l)\epsilon C^M$, $$X(l) \triangleq [X_1(l) \ldots X_M(l)]^T,$$

where the superscript $\bullet^T$ denotes the transposition. Analogous expressions hold for the clean DFT coefficient vector S(l) and the noise DFT coefficient vector V(l), so that $$X(l)=S(l)+V(l).$$

For a given frame index l and frequency index k, let $d'(l)=[d'_1(l) \ldots d'_M(l)]^T$ denote the (complex-valued) acoustic transfer function from target source to each microphone. It is often more convenient to operate with a normalized version of d'(l). More specifically, choosing the $i^{th}$ microphone as a reference, then $$d(l)=d'(l)/d'_i(l)$$

denotes a vector whose elements $d_m$ are the transfer functions from each microphone to the reference. We refer to d(l) as a relative transfer function. Then, S(l) may be written as, $$S(l)=\overline{S}(l)d(l) \tag{1}$$

where $\overline{S}(l)$ is the target DFT coefficient with frame index l at the frequency index in question, measured at the reference microphone. Eq. (1) decomposes the target vector S(l) into a factor, $\overline{S}(l)$, which depends on the source signal only, and a factor d(l), which depends on the acoustics only.

The inter-microphone cross power spectral density (CPSD) matrix $C_X(l)=E[X(l)X^H(l)]$ of the noisy observation can now be written as $$C_X(l)=\lambda_S(l)d(l)d^H(l)+E[V(l)V^H(l)]$$

where the first term represents the CPSD of the target $C_S(l)=\lambda_S(l)d(l)d^H(l)$ and the second term represents the CPSD of the noise $C_V(l)=E[(l)V^H(l)]$, and where the superscript $^H$ denotes Hermitian transposition, and $\lambda_S(l)=E[|\overline{S}(l)|^2]$ is the power spectral density (psd) of the target signal at the frequency index kin question.

Finally, let us assume the following model for the temporal evolution of the noise covariance matrix across time, during signal regions with speech presence. Let $l_0$ denote the most recent frame index where speech was absent, so that $l>l_0$ are frame indices with speech activity. We assume the noise covariance matrix to evolve across time according to the following model [3]

$$C_V(l)=\lambda_V(l)C_V(l_0),\ l>l_0 \tag{2}$$

where $C_V(l_0)$ is a scaled noise covariance matrix at the most recent frame index $l_0$ where the target signal was absent. For convenience, this matrix is scaled such that element $(i_{ref}, i_{ref})$ equals one. Then, $\lambda_V(l)$ is the time-varying psd of the noise process, measured at the reference position. Thus, during speech presence, the noise process does not need to be stationary, but the covariance structure must remain fixed up to a scalar multiplication. This situation would e.g. occur when noise sources are spatially stationary with co-varying power levels.

Hence, the covariance matrix of the noisy observation during speech activity can be summarized as $$C_X(l)=\lambda_S(l)d_\theta(l)d_\theta^H(l)+\lambda_V(l)C_V(l_0),\ l>l_0 \tag{3}$$

The RTF vector $d_\theta(l)$, the time-varying speech psd $\lambda_S(l)$ and the time-varying noise scaling factor $\lambda_V(l)$ are all unknown. The subscript θ denotes the $\theta^{th}$ element of an RTF dictionary D. The matrix $C_V(l_0)$ can be estimated in speech absent signal regions, identified using a voice activity detection algorithm, and is assumed known.

Maximum Likelihood Estimation of RTF Vectors $d_\theta(l)$

In the following it is assumed that an RTF dictionary, $d_\theta\epsilon\Theta$ is available (e.g. estimated or measured in advance of using the system; possibly updated during use of the system). The goal is to find the ML estimate of $d_\theta\epsilon\Theta$ based on the noisy microphone signals X(l).

From the assumptions above it follows that vector X(l) obeys a zero-mean (complex, circular symmetric) Gaussian probability distribution, that is, $$f_{X(l)}(X(l); \lambda_S(l), \lambda_V(l)) = \frac{1}{\pi^M|C_X(l)|}\exp(X^H(l)C_X^{-1}(l)X(l)), \tag{4}$$

where $|\bullet|$ denotes the matrix determinant. We require $C_X(l)$ to be invertible. In practice, this is no problem as microphone self-noise will ensure that $C_V(l_0)$ and hence $C_X(l)$ has full rank. Let $\underline{X}_D(l)\epsilon C^{M\times D}$ denote a matrix with D observed vectors, X(j), j=l−D+1 . . . , l, as columns, $$\underline{X}_D(l)=[X(l-D+1) \ldots X(l)].$$

Since spectral observations $X_m(l)$ are assumed independent across time l, the likelihood function of successive observations is given by $$f_{\underline{X}(l)}(\underline{X}(l); d_\theta, \lambda_S, \lambda_V) = \prod_{j=l-D+1}^{l} f_{X(j)}(X(j); d_\theta, \lambda_S, \lambda_V), \tag{5}$$

under the short-time stationarity assumption that $\lambda_V(j) \triangleq \lambda_V$, $\lambda_S(j) \triangleq \lambda_S$, and d=d(j) for j=l−D+1, . . . , l. The corresponding log-likelihood function is given by $$\mathcal{L}(l) = \log f_{\underline{X}(l)}(\underline{X}(l); d_\theta, \lambda_S, \lambda_V) = -DM\log\pi - D\log|C_X(l)| - Dtr\left(C_X^{-1}(l)\hat{C}_X(l)\right), \tag{6}$$

tr represents the trace operator, i.e. the sum of the main diagonal elements of the matrix, and where $C_X(l)$ is a function of $d_\theta$, $\lambda_V$, and $\lambda_S$ and is given in Eq. (3), and where $$\hat{C}_X(l) = \frac{1}{D}\sum_{j=l-D+1}^{l} X(j)X^H(j). \tag{7}$$

To find the ML estimate of $d_\theta$, we evaluate the log-likelihood for each $d_\theta \in \Theta$, and pick the one leading to maximum log-likelihood. Let us consider how to compute the log-likelihood for a particular $d_\theta$. The likelihood function $\mathcal{L}(l)$ is a function of unknown parameters $d_\theta$, $\lambda_V(l)$ and $\lambda_S(l)$. To compute the likelihood for a particular $d_\theta$, we therefore substitute the ML estimates of $\lambda_V(l)$ and $\lambda_S(l)$, which depend on the choice of $d_\theta$, into Eq. (6).

The ML estimates of $\lambda_V(l)$ and $\lambda_S(l)$ are derived in [4] and equivalent expressions are derived in [3, 5]. Specifically, let $B_\theta(l) \in C^{M\times M-1}$ denote a blocking matrix whose columns form a basis for the M−1 dimensional vector space orthogonal to $d_\theta(l)$, so that $d_\theta^H(l)B_\theta(l)=0$. The matrix $B_\theta$ may be found as follows. Define the M×M matrix $$H_\theta = I_m - \frac{d_\theta d_\theta^T}{d_\theta^T d_\theta}.$$

Then $B_\theta$ may be found as the first M−1 columns of $H_\theta$, i.e., $B_\theta = H_\theta(:, 1{:}M-1)$. With this definition of $B_\theta$, the ML estimate of $\lambda_V(l)$ is given by [3-5]:

$$\hat{\lambda}_{V,\theta}(l) = \frac{1}{M-1}tr\left(\frac{1}{D}X_D^H(l)B_\theta(l)(B_\theta^H(l)C_V(l_0)B_\theta(l))^{-1}B_\theta^H(l)X_D(l)\right). \tag{8}$$

Eq. (8) may be interpreted as the average variance of the observable noisy vector X(l), passed through M−1 linearly independent target canceling beamformers, and normalized according to the noise covariance between the outputs of each beamformer.

The ML estimate of $\lambda_S(l)$ may be expressed as follows, where the weight vector $w_\theta(l) \in C^M$ for an MVDR beamformer is given by, e.g., [6], $$w_\theta(l) = \frac{C_V^{-1}(l)d_\theta(l)}{d_\theta^H(l)C_V^{-1}(l)d_\theta(l)} = \frac{C_V^{-1}(l_0)d_\theta(l)}{d_\theta^H(l)C_V^{-1}(l_0)d_\theta(l)}. \tag{9}$$

With this expression in mind, the ML estimate $\hat{\lambda}_{S,\theta}(l)$ can be written as (see e.g. [4, 5]):

$$\hat{\lambda}_{S,\theta}(l) = w_\theta^H(l)(\hat{C}_X(l) - \hat{\lambda}_{V,\theta}(l)C_V(l_0))w_\theta(l). \tag{10}$$

In words, the ML estimate $\hat{\lambda}_{S,\theta}(l)$ of the target signal variance is simply the variance of the noisy observation X(l) passed through an MVDR beamformer, minus the variance of a noise signal with the estimated noise covariance matrix, passed through the same beamformer.

Inserting the expressions for $\hat{\lambda}_{V,\theta}(l)$ and $\hat{\lambda}_{S,\theta}(l)$ in the the expression for the log-likelihood (Eq. (6)), we arrive at the expression [4]:

$$\mathcal{L}_\theta(l) = DM\log D\log|\hat{\lambda}_S(d_\theta)d_\theta d_\theta^H + \hat{\lambda}_V(d_\theta)C_V(l_0)| - DM, \tag{11}$$

where we have now indicated the explicit dependency of the likelihood on the RTF vector $d_\theta$.

The ML $d_{\theta*}$ estimate of $d_\theta$ is simply found as $$d_{\theta*} = \underset{d_\theta \in \Theta}{\operatorname{argmax}}\,\mathcal{L}_\theta(l). \tag{12}$$

Computing the Log-Likelihood Efficiently

In order to find an ML estimate of the RTF vector, the log-likelihood $\mathcal{L}_\theta(l)$ (Eq. 11) must be evaluated for every $d_\theta$ in the RTF dictionary. We discuss in the following how to evaluate $\mathcal{L}_\theta(l)$ efficiently.

Note that the first and the third term in Eq. (11) are independent of $d_\theta$, so that $$\mathcal{L}_\theta(l) \propto -D\log|\hat{\lambda}_S(d_\theta)d_\theta d_\theta^H + \hat{\lambda}_V(d_\theta)C_V(l_0)|. \tag{13}$$

Next, to compute this determinant efficiently, note that the argument of the determinant is a rank-one update, $\hat{\lambda}_S(d_\theta)d_\theta d_\theta^H$, of a full-rank matrix, $\hat{\lambda}_V(d_\theta)C_V(l_0)$. We use that for any invertible matrix A and vectors u, v of appropriate dimensions, it holds that $$|A + uv^T| = (1 + v^T A^{-1}u)|A|. \tag{14}$$

Applying this to Eq. (13), we find that $$\begin{aligned}\mathcal{L}_\theta(l) \propto -\log\left|\hat{\lambda}_{S,\theta}d_\theta d_\theta^H + \hat{\lambda}_{V,\theta}C_V(l_0)\right| &= \\ -\log\left\{\left(1 + \hat{\lambda}_{S,\theta}d_\theta^T\left(\hat{\lambda}_{V,\theta}C_V(l_0)\right)^{-1}d_\theta\right)\left|\hat{\lambda}_{V,\theta}C_V(l_0)\right|\right\} &= \\ -\log\left\{\left(1 + \frac{\hat{\lambda}_{S,\theta}}{\hat{\lambda}_{V,\theta}}d_\theta^T C_V(l_0)^{-1}d_\theta\right)\hat{\lambda}_{V,\theta}^M|C_V(l_0)|\right\} &= \\ -\log\left\{\left(1 + \frac{\hat{\lambda}_{S,\theta}(l)}{\hat{\lambda}_{V,\theta}w_\theta^H C_V(l_0)w_\theta}\right)\hat{\lambda}_{V,\theta}^M|C_V(l_0)|\right\}.\end{aligned} \tag{15}$$

where $w_\theta(l)$ are MVDR beamformers in the direction of $d_\theta$.

Further Simplifications for M=2

To simplify this expression further, the M=2 microphone situation is considered. For M=2, the expression for $\hat{\lambda}_V(l)$ (Eq. (8)) simplifies to $$\hat{\lambda}_{V,\theta,M=2} = \frac{b_\theta^H\hat{C}_X(l)b_\theta}{b_\theta^H\hat{C}_V(l_0)b_\theta}, \tag{16}$$

where $b_\theta$ is the blocking matrix (which is a 2×1 vector in the M=2 case). Note that the target cancelling beamformer weights $b_\theta$ are signal independent and may be computed a priori (e.g. in advance of using the system).

Inserting Eq. (16) and (10) into Eq. (15), we arrive at the following expression for the log likelihood, $$\mathcal{L}_{\theta,M=2}(l) \propto -\log\left\{\frac{w_\theta^H(l)\hat{C}_X(l)w_\theta(l)}{w_\theta^H(l)\hat{C}_V(l_0)w_\theta(l)} \times \frac{b_\theta^H\hat{C}_X(l)b_\theta}{b_\theta^H\hat{C}_V(l_0)b_\theta} \times |C_V(l_0)|\right\} = -\log\left\{\frac{w_\theta^H(l)\hat{C}_X(l)w_\theta(l)}{w_\theta^H(l)\hat{C}_V(l_0)w_\theta(l)}\right\} - \log\left\{\frac{b_\theta^H\hat{C}_X(l)b_\theta}{b_\theta^H\hat{C}_V(l_0)b_\theta}\right\} - \log|C_V(l_0)|. \quad (17)$$

The first term involving MVDR beamformers $w_\theta(l)=C_V^{-1}(l_0)d_\theta/d_\theta^T C_V^{-1}(l_0)d_\theta$ may be simplified for the M=2 case. First note that $w_\theta$ appears twice in the numerator and denominator of the first term. Hence, the denominator $d_\theta^T C_V^{-1}(l_0)d_\theta$ of the beamformer expression vanishes. Furthermore, note that for M=2, the inverse of a matrix $$A = \begin{bmatrix} a11 & a12 \\ a21 & a22 \end{bmatrix}$$

is given by $$A^{-1} = \frac{1}{|A|}\tilde{A}, \text{ where } \tilde{A} = \begin{bmatrix} a22 & -a12 \\ -a21 & a11 \end{bmatrix}. \quad (18)$$

Hence, the expression for the beamformers $w_\theta(l)$ in the first term of Eq. (17) may simply be substituted by $$w_\theta = \tilde{C}_V(l_0)d_\theta(l), \quad (19)$$

where the elements of $\tilde{C}_V(l_0)$ are found by re-arranging the elements of $C_V(l_0)$ according to Eq. (18).

Note that the expression in Eq. (17) is computationally efficient for applications such as hearing instruments in that it avoids matrix inverses, eigen-values, etc. The first term is the log-ratio of the variance of the noisy observation, passed through an MVDR beamformer, to the variance of the signal in the last noise-only region, passed through the same MVDR beamformer. The second term is the log-ratio of the variance of the noisy observation, passed through a target-canceling beamformer, to the variance of the signal in the last noise-only region, passed through the same target-canceling beamformer.

We can summarize how the log-likelihood can be computed efficiently:

Given $d_\theta$, $\theta=1, \ldots, \theta_N$, where $\theta_N$ is the number of different locations/directions represented in the dictionary $\Theta$, compute corresponding signal-independent target canceling beamformer weights $b_\theta$, $\theta=1, \ldots, \theta_N$, (see above Eq. (10). Then, Compute (scaled) MVDR beamformers (whenever $C_V(l_0)$ changes):

$$w_\theta(l) = \tilde{C}_V(l_0)d_\theta(l),\ \theta=1, \ldots, \theta_N \quad (20)$$

Compute output variances of beamformers (whenever $C_V(l_0)$ changes): $w_\theta^H(l)C_V(l_0)w_\theta(l)$ and $b_\theta^H C_V(l_0)b_\theta$ for all $\theta=1, \ldots, \theta_N$.

Compute output variances of beamformers (for every $X(l)$): $w_\theta^H(l)\hat{C}_X(l)w_\theta(l)$ and $b_\theta^H\hat{C}_X(l)b_\theta$ for all $\theta=1, \ldots, \theta_N$.

Compute determinants $|C_V(l_0)|$ (whenever $C_V(l_0)$ changes).

Compute log-likelihoods by summing the log of the variances and the log of the determinant above (Eq. (17)).

The target cancelling beamformer weights $b_\theta$ can e.g. be computed offline—one set of weights per dictionary element or computed directly from $d_\theta$ as described in eq. (8) above.

Figure 10:
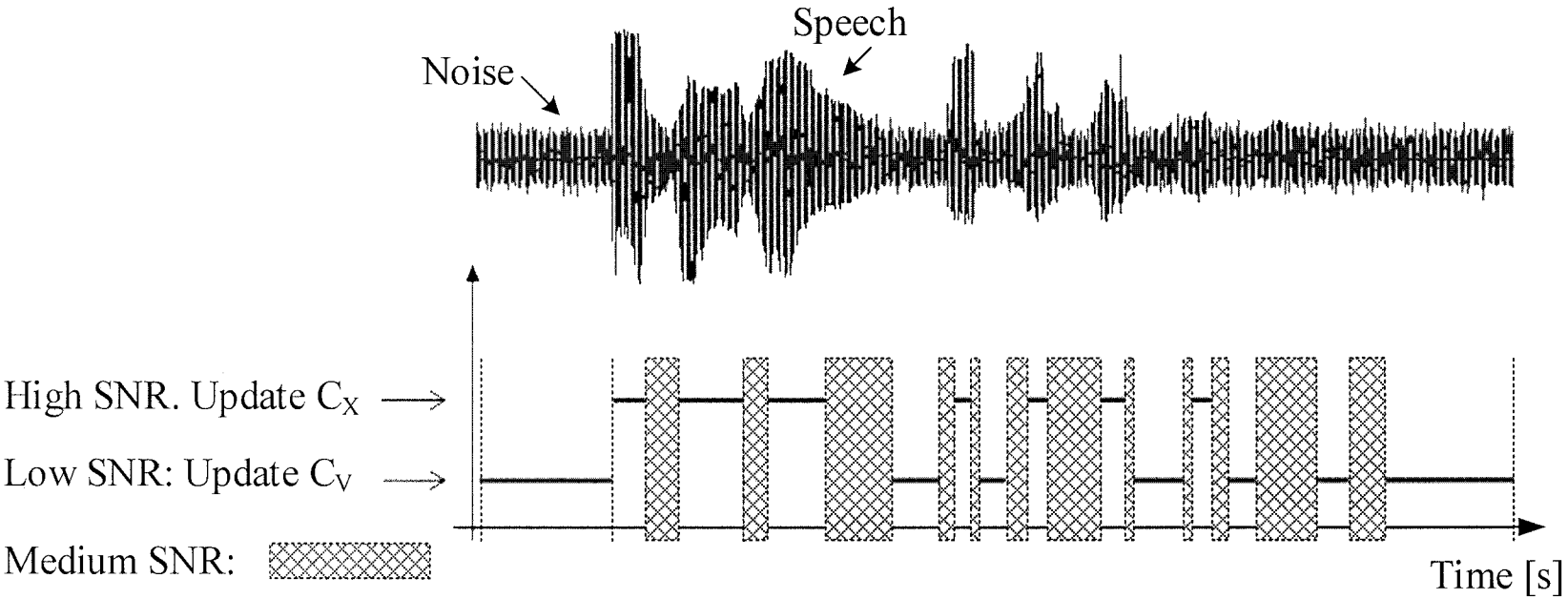
FIG. 10 illustrates an exemplary sound segment, comprising sub-segments with speech and sub-segments with speech pauses, and a consequent update strategy of the noisy and noise covariance matrices, respectively.

In principle, we calculate $C_X$ for all frames, while $C_V$ only is updated in noise-only frames (last frame, where $C_V$ has been updated is denoted by $l_0$). We may however avoid updating $C_X$ in noise only frames as we do not expect the direction to change in those regions (unless we receive other information such as head movements). We may choose only to update $C_X$ in regions when speech is detected, cf. FIG. 10. FIG. 10 illustrates an exemplary sound segment over time (cf. horizontal axis denoted Time [s]), comprising (time-) sub-segments with speech (denoted 'High SNR: Update $C_x$') and sub-segments with speech pauses (possibly comprising noise alone, 'Low SNR: Update $C_V$'), and sub-segments with a mixture of speech and noise (denoted Medium SNR, and indicated by cross-hatched rectangles along the time axis in FIG. 10). As we update the noise covariance matrix $C_v$ only in time frames with low signal to noise ratio, we may choose only to update the 'noisy' (target+noise) covariance matrix $C_x$ in time frames with high SNR. Hereby we avoid that the log likelihood is updated too frequently. As we see, in some frames (cross-hatched time-segments), neither $C_v$ nor $C_x$ are updated as the estimated SNR is in between low and high ('Medium' in FIG. 10). The exemplified drawing is showing the signal in the time domain. Typically, the SNR will be estimated in each frequency channel. Thus $l_0$ in one frequency channel may differ from an $l_0$ in another frequency channel. In the case, where $C_v$ is only updated in speech pauses and $C_x$ is only updated during speech, $$\mathcal{L}_{\theta,M=2}(l) \propto -\log\left\{\frac{w_\theta^H(l)\hat{C}_X(l_1)w_\theta(l)}{w_\theta^H(l)\hat{C}_V(l_0)w_\theta(l)} \times \frac{b_\theta^H\hat{C}_X(l_1)b_\theta}{b_\theta^H\hat{C}_V(l_0)b_\theta} \times |C_V(l_0)|\right\} = -\log\left\{\frac{w_\theta^H(l)\hat{C}_X(l_1)w_\theta(l)}{w_\theta^H(l)\hat{C}_V(l_0)w_\theta(l)}\right\} - \log\left\{\frac{b_\theta^H\hat{C}_X(l_1)b_\theta}{b_\theta^H\hat{C}_V(l_0)b_\theta}\right\} - \log|C_V(l_0)|. \quad (17)$$

$l_1$ denote the last frame where speech was active.

Alternatively, $C_v$ and $C_x$ are also updated in the medium SNR region. Instead of either updating or not updating the covariance matrices, the smoothing time constants could be SNR-dependent such that the time constant of $C_v$ increases with increasing SNR until it becomes infinitely slow in the "high" SNR region likewise the time constant of $C_x$ increases with decreasing SNR until it becomes infinitely slow at "low" SNR. This implementation will however become computationally more expensive as the different terms of the likelihood function are updated more frequent.

Figure 11A:
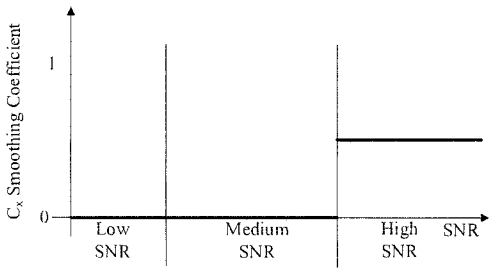
FIG. 11A shows a smoothing coefficient versus SNR for a noisy target signal covariance matrix $C_x$ for a speech in noise situation as illustrated in FIG. 10 where no SNR-dependent smoothing is present for medium values of SNR.
Figure 11B:
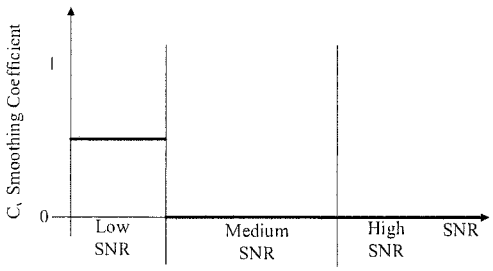
FIG. 11B shows a smoothing coefficient versus SNR for a noise covariance matrix $C_v$ for a speech in noise situation as illustrated in FIG. 10, where no SNR-dependent smoothing is present for medium values of SNR.

FIGS. 11A and 11B illustrate a smoothing coefficient versus SNR for a noisy target signal covariance matrix $C_x$ and a noise covariance matrix $C_v$, respectively, for a speech in noise situation as illustrated in FIG. 10 where no SNR-dependent smoothing is present for medium values of SNR.

Figure 11C:
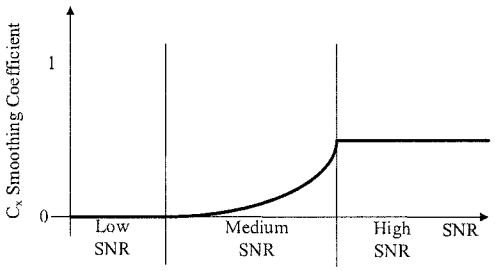
FIG. 11C shows a smoothing coefficient versus SNR for a noisy target signal covariance matrix $C_x$ for a speech in noise situation comprising a first SNR-dependent smoothing scheme also for medium values of SNR.
Figure 11D:
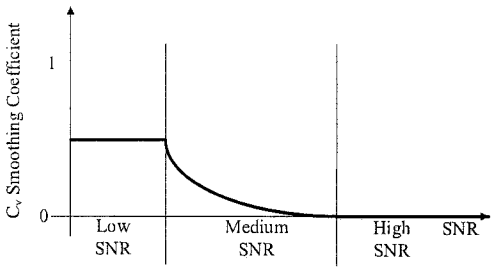
FIG. 11D shows a smoothing coefficient versus SNR for a noise covariance matrix $C_v$ for a speech in noise situation comprising a first SNR-dependent smoothing scheme also for medium values of SNR.

FIGS. 11C and 11D illustrate a smoothing coefficient versus SNR for a noisy target signal covariance matrix $C_x$ and a noise covariance matrix $C_v$, respectively, for a speech in noise situation comprising a first SNR-dependent smoothing scheme also for medium values of SNR.

Figure 11E:
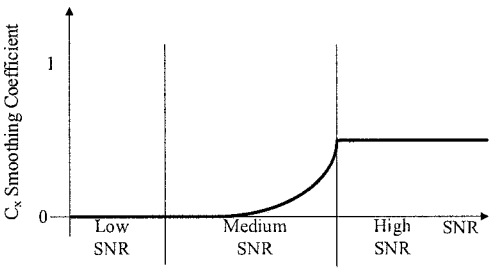
FIG. 11E shows a smoothing coefficient versus SNR for a noisy target signal covariance matrix $C_x$ for a speech in noise situation comprising a second SNR-dependent smoothing scheme also for medium values of SNR.
Figure 11F:
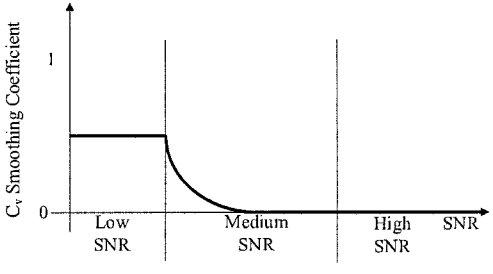
FIG. 11F shows a smoothing coefficient versus SNR for a noise covariance matrix $C_v$ for a speech in noise situation comprising a second SNR-dependent smoothing scheme also for medium values of SNR.

FIGS. 11E and 11F illustrate a smoothing coefficient versus SNR for a noisy target signal covariance matrix $C_x$ and a noise covariance matrix $C_v$, respectively, for a speech in noise situation comprising a second SNR-dependent smoothing scheme also for medium values of SNR.

FIG. 11A-11F illustrates examples of SNR-dependent smoothing coefficients. The amount of smoothing (defined by IIR smoothing time constant $\tau$) can be derived from the smoothing filter coefficient $\lambda$ as $$\tau = \frac{-1}{\log(1-\lambda)F_s},$$

where $F_S$ is the sample frequency. From the expression for $\tau$, it is clear that the smoothing time constant becomes 0 when $\lambda \rightarrow 1$ (if the time constant becomes 0, the estimate only depends on the current sample) and as $\lambda \rightarrow 0$, the smoothing time constant becomes infinitely slow (update will be stalled). FIG. 11A shows the case of FIG. 10, where $C_x$ is only updated when the SNR is high. At medium or low SNR, $C_x$ is not updated. FIG. 11C shows the same case, where $C_x$ also is allowed to be updated at medium SNR with decreasing time constant starting at no update at low SNR until the High SNR smoothing time constant has been reached. As illustrated in FIG. 11E, the update of $C_x$ might be stalled at SNR levels higher than the low SNR level, as the low SNR threshold mainly is a threshold related to the update of $C_v$. Likewise FIG. 11B resembles the smoothing of $C_v$ shown in FIG. 10. Only at low SNR, $C_v$ is smoothed with a certain time constant. Above this threshold the update of $C_v$ is stalled. In FIG. 11D and FIG. 11F, the smoothing is gradually decreased at higher SNR levels until a level, where the smoothing is stalled is reached. In an embodiment, the smoothing is never stalled, i.e. the smoothing coefficient never becomes 0. In another embodiment, the smoothing coefficients are limited to $\lambda=2^{-N}$, where $N \epsilon 0, 1, 2, 3, 4, \ldots$ In an embodiment, the SNR range, where $C_x$ is updated does not overlap with the SNR range, where $C_v$ is updated (hereby possibly avoiding $C_x=C_v$).

FIGS. 10 and 11A-11F relate to SNR dependent smoothing coefficients. The present inventors have proposed an alternative smoothing scheme, termed 'adaptive covariance smoothing', where smoothing coefficients are determined in dependence of changes in the covariance matrices. This smoothing scheme is outlined below in connection with FIG. 13A, 13B. 13C.

Constrained ML RTF Estimators

The algorithm above is described per frequency band: within a frequency-band $FB_k$, k=1, . . . , K, it describes how the ML RTF estimate $d_{\theta*}$ may be found by computing the log-likelihood $L(d_\theta)$ for each candidate $d_\theta$ ($\theta=\theta_1, \ldots, \theta_N$) from a dictionary (where each $d_\theta$ is vector comprising M elements $d_\theta=[d_{\theta,1}(k), \ldots, d_{\theta,M}(k)]^T$), and selecting the one ($d_{\theta*}$) leading to largest likelihood. Rather than estimating the ML RTF vector independently in each frequency band ($d_{\theta*}$)(k=1, . . . , k=K) (which may lead to different values of $\theta*$ for different frequency bands $FB_k$), it is often reasonable to estimate the ML RTF vectors jointly across (some or all) frequency bands. In other words, it may be reasonable to look for the set of RTF vectors (one for each frequency band) that all "point" towards the same spatial position (so that $\theta*$ is NOT different for different $FB_k$). Finding this joint set of RTF vectors is straight-forward in the proposed framework. Specifically, based on the standard assumption that sub-band signals are statistically independent, the log-likelihood for a set of RTF vectors is equal to the sum of their individual log-likelihoods.

Let $\mathcal{L}_{\theta,k}$ denote the log-likelihood computed for the $\theta^{th}$ RTF vector in frequency band k. The ML estimate of the set of RTF vectors that all "point" towards the same spatial position is then found by choosing the $\theta*^{th}$ RTF vector for each frequency band, where $$\theta^* = \arg\max_\theta \sum_k \mathcal{L}_{\theta,k}. \tag{21}$$

In a similar manner it is straightforward to constrain the estimated RTF vectors in each hearing aid to "point" towards the same spatial position, or to apply this constraint for both hearing aids and/or for all frequency bands.

Computing a Posterior DOA Probabilities

Having computed the log-likelihoods for each direction $\theta$ in Eq. (17), it is straightforward to convert these into posterior DOA probabilities. Posterior DOA probabilities are often advantageous because they are easier to interpret and can better be used for visualization, etc. Using the log-likelihood in Eq. (17), the corresponding likelihood can be written as $$f_{\underline{X}(l)}(\underline{X}(l);d_\theta)=\exp(\mathcal{L}_{\theta,M-2}(l)), \tag{22}$$

From Bayes rule, the DOA posterior probability is given by $$\begin{aligned} P(d_\theta;\, \underline{X}(l)) &= \frac{f_{\underline{X}(l)}(\underline{X}(l);\, d_\theta)P(d_\theta)}{f_{\underline{X}(l)}(\underline{X}(l))} \\ &= \frac{f_{\underline{X}(l)}(\underline{X}(l);\, d_\theta)P(d_\theta)}{\sum_\theta f_{\underline{X}(l)}(\underline{X}(l);\, d_\theta)P(d_\theta)}, \end{aligned} \tag{23}$$

where $P(d_\theta)$ is the prior probabilities of $d_\theta$. For a "flat" prior, $P(d_\theta)=1/N_\Theta$, we find the particularly simple result that the posterior probability is given by the normalized likelihood $$P(d_\theta;\, \underline{X}(l)) = \frac{f_{\underline{X}(l)}(\underline{X}(l);\, d_\theta)}{\sum_\theta f_{\underline{X}(l)}(\underline{X}(l);\, d_\theta)}, \tag{24}$$

which is very easy to evaluate, given that the likelihood values (Eq. (17)) are computed anyway.

Additional Modalities

The description so far has considered the situation where direction estimates $d_\theta$ are based on microphone signals X(l). However, in future hearing aid systems, additional information apart from sound signals captured by microphones—may be available; these include, for example, information of the eye gaze direction of the hearing aid user, information about the auditory attention of the user, etc. In many situations, this additional information can provide very strong evidence of the direction of an active target talker, and, hence, help identify the target direction. For example, it is often the case that a hearing aid user looks at the target sound source of interest, at least now and then, e.g. for lip reading in acoustically difficult situations. It is possible to extend the framework described above to take into account these sources of additional information. Let us introduce the variable e(l) to describe any such additional information. Let as an example e(l) describe the eye gaze direction of a user. In addition or alternatively, many other sources of additional information exist and may be incorporated in the presented framework in a similar manner.

Maximum Likelihood Estimates of $d_\theta$

The total information o(l) available to the hearing aid system at a particular time instant l is given by:

$$o(l)=[\underline{X}(l)e(l)],$$

and the likelihood function is given by $$\mathcal{L}_\theta(l;d_\theta)=\log f_{o(l)}(o(l);d_\theta). \tag{25}$$

As above, the maximum likelihood estimate of $d_\theta$ is given by $$d_{\theta^*} = \arg\max_{d_\theta} \mathcal{L}_\theta(l;\, d_\theta). \tag{26}$$

As before, Eq. (26) may be evaluated by trying out all candidate vectors $d_\theta \in \Theta$. The computations required to do this depends on which statistical relations exist (or are assumed) between the microphone observations $\underline{X}(l)$ and the additional information e(l). It should be noted that likelihood estimates as well as log likelihood estimates are represented by the same symbol, L (or $\mathcal{L}$ in equations/expressions), in the present disclosure.

EXAMPLE

A particularly simple situation occurs, if it is assumed that X(l) and e(l) are statistically independent:

$$\begin{aligned} f_{o(l)}(o(l);\, d_\theta) &\triangleq f_{|\underline{X}(l)e(l)|}(|\underline{X}(l)e(l)|;\, d_\theta) \\ &= f_{\underline{X}(l)}(\underline{X}(l);\, d_\theta) \times f_{e(l)}(e(l);\, d_\theta). \end{aligned} \tag{27}$$

so that $$\begin{aligned} \mathcal{L}_j(l) &= \log f_{o(l)}(o(l);\, d_\theta) \\ &= \log f_{\underline{X}(l)}(\underline{X}(l);\, d_\theta) + \log f_{e(l)}(e(l);\, d_\theta). \end{aligned} \tag{28}$$

In this situation, the first term is identical to the microphone-signals-only log-likelihood function described in Eq. (11). The second term depends on the probability density function $f_{e(l)}(e(l);\, d_\theta)$ which may easily be measured, e.g. in and off-line calibration session, e.g. prior to actual usage (and/or updated during use of the system).

Maximum a Posteriori Estimates of $d_\theta$

Instead of finding maximum likelihood estimates of $d_\theta$ as described above, maximum a posteriori (MAP) estimates of $d_\theta$ may be determined. The MAP approach has the advantage of allowing the use of additional information signal e(n) in a different manner than described above.

The a posteriori probability $P(d_\theta;\, \underline{X}(l))$ of $d_\theta$, given the microphone signals $\underline{X}(l)$ (for the microphone-observations-only situation), was defined in Eq. (23). To find MAP estimates of $d_\theta$, one must solve $$\begin{aligned} d_\theta &= \arg\max_{d_\theta} P(d_\theta;\, \underline{X}(l)) \\ &= \arg\max_{d_\theta} f_{\underline{X}(l)}(\underline{X}(l);\, d_\theta) P(d_\theta). \end{aligned} \tag{29}$$

Note that the first factor is simply the likelihood, whereas the second term is a prior probability on the $d_\theta$'s. In other words, the posterior probability is proportional to the likelihood function, scaled by any prior knowledge available. The prior probability describes the intrinsic probability that a target sound occurs from a particular direction. If one has no reason to believe that target signals tend to originate from a particular direction over another, one could choose a uniform prior, $P(d_\theta)=1/N_\Theta$, $\theta=1, \ldots, N_\Theta$, where $N_\Theta$ denotes the number of candidate vectors. Similarly, if one expects target sources to be primarily frontal, this could be reflected in the prior by increasing the probabilities from frontal directions. As for the maximum likelihood criterion, evaluation of the criterion may be done by trying out candidate $d_\theta$'s and choosing the candidate that maximizes the posterior probability.

Example

We propose here to derive the prior probability $P(d_\theta)$ from the additional information signal e(n). For example, if e(n) represents an eye-gaze signal, one could build a histogram of "preferred eye directions" (or 'hot spots') across past time periods, e.g., 5 seconds. Assuming that the hearing aid user looks at the target source now and then, e.g., for lip-reading, the histogram is going to show higher occurrences of that particular direction than other. The histogram is easily normalized into a probability mass function $P(d_\theta)$ which may be used when finding the maximum a posteriori estimate of $d_\theta$ from Eq. (29). Also other sensor data may contribute to a prior probability, e.g. EEG measurements, feedback path estimates, automatic lip reading, or movement sensors, tracking cameras, head-trackers, etc. Various aspects of measuring eye gaze using electrodes of a hearing device are discussed in our co-pending European patent application number 16205776.4 with the title A hearing device comprising a sensor for picking up electromagnetic signals from the body, filed at the European patent office on 21 Dec. 2016 (published as EP3185590A1).

Figure 9A:
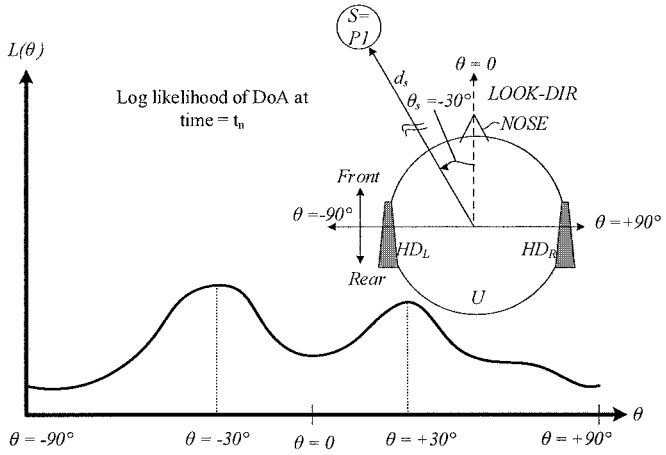
FIG. 9A, 9B, 9C illustrates different aspects of a use scenario comprising a listener and two talkers, wherein additional information to qualify a DoA (angle θ) likelihood estimate L(θ) according to the present disclosure is provided, where FIG. 9A schematically shows a log likelihood evaluation of direction of arrival at a given point in time $t_n$, and a corresponding geometrical setup of user and sound source.
Figure 9B:
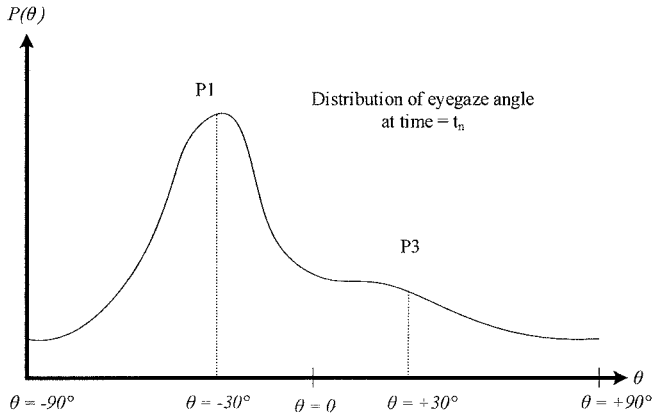
Figure 9C:
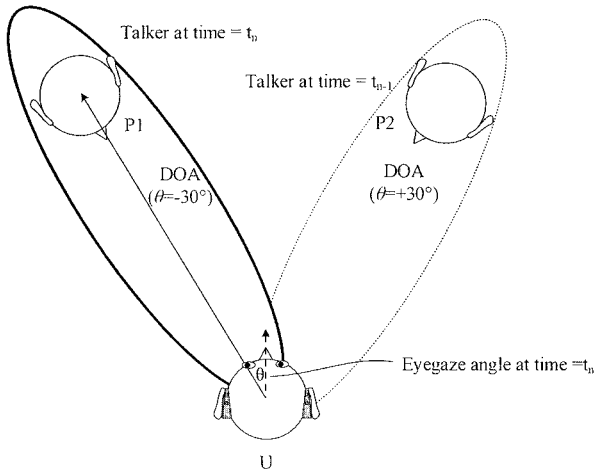

FIG. 9A, 9B, 9C illustrates different aspects of such scenario. FIG. 9C shows an exemplary scenario comprising two (e.g. alternate or simultaneous) first and second talkers (P1, P2) and a listener (U) wearing a hearing system, according to the present disclosure. In the illustrated situation the two talkers are situated in the front half plane of the user, here at horizontal angles θ=−30° (P1), and θ=+30° (P2), respectively. FIG. 9C illustrates a scenario at a time instant $t_n$, where the first talker speaks (as indicated by the solid bold elliptic enclosure, and text 'Talker at time $t_n$')) coming from a situation at time instant $t_{n-1}$, where the second talker spoke (as indicated by the dotted elliptic enclosure, and text 'Talker at time $t_{n-1}$')). This shift in speech activity from the second to the first talker is reflected in a change of the user's eye gaze (or a combination of eye gaze and head movement), from angle θ=+30° (attending to second talker P2) to θ=−30° (attending to first talker P1). In an embodiment, eye gaze may be used to resolve left-right confusions (of the algorithm, cf. FIG. 9A, 9B). Assuming that the user wears some sort of eye gaze monitoring device(s), e.g. a pair of hearing devices or glasses comprising one or more eye tracking cameras and/or electrodes for picking up differences in potentials from the user's body (e.g. including around an ear and/or an ear canal), and/or a head-tracker for monitoring the movement of the head of the user, such information can be used in the scenario of FIG. 9C to give additional (prior) knowledge to likely directions to currently active audio sources (here first and second talkers P1, P2). FIG. 9B illustrates such additional information available at time $t_n$ where the user has shifted attention from second (P2)

to first talker (P1). FIG. 9B may illustrate a distribution function for likely values of eye gaze angle of the user (U) in the scenario of FIG. 9C. The distribution function P(θ) may typically depend on the time period over which it is recorded (and on the individual speech probabilities of the first and second talkers). For longer recording times it would be expected to see two peaks around θ=−30° (P1), and θ=+30° (P2). This additional (or 'prior') information may be used to qualify the likelihood estimate L(θ) (e.g. a log likelihood estimate) of directional of arrival (DoA) as schematically illustrated in FIG. 9A, and provided by a microphone system (or e.g. a binaural hearing aid system) according to the present disclosure. In this case, the additional information from distribution function P(θ), shown in FIG. 9B, may justify the peak at θ=−30° of likelihood estimate L(θ) and point to this over the peak at θ=+30° as the most likely angle for DoA at time=$t_n$. The distribution function P(θ) and the likelihood estimate L(θ) may be multiplied together to give an improved likelihood estimate (see e.g. eq. (28) above). Eye gaze, head movement (e.g. based on accelerometer, magnetometer, or gyroscope) may all influence the time constants of covariance matrices $C_v$ and $C_x$.

Joint Direction-of-Arrival Decision

Given the log-likelihood in Eq. (17), we can choose either to make single direction-of-arrival decisions at each hearing instrument and for each frequency channel, or we can choose to make a joint decision across frequency as shown in Eq. (21). For the M=2 case, our joint likelihood function across frequency is given by $$\mathcal{L}_{\theta,M=2}(l) = \sum_k \mathcal{L}_{\theta,M=2}(l,k) \tag{31}$$

$$= \sum_k \left( -\log\left\{ \frac{w_\theta^H(l,k)\hat{C}_X(l,k)w_\theta(l,k)}{w_\theta^H(l,k)\hat{C}_V(l_0,k)w_\theta(l,k)} \right\} - \log\left\{ \frac{b_\theta^H(k)\hat{C}_X(l,k)b_\theta(k)}{b_\theta^H(k)\hat{C}_V(l_0,k)b_\theta(k)} \right\} - \log|C_V(l_0,k)| \right)$$

Assuming a flat prior probability, we can find the most likely direction-of-arrival from Eq. (21) as $$\theta^* = \arg\max_\theta \mathcal{L}_{\theta,M=2}. \tag{32}$$

It is an advantage to find the most likely direction θ* directly from the joint likelihood function $\mathcal{L}_{\theta,M=2}$ compared to finding θ* from the posterior probability. If we would like to apply a non-uniform prior probability, e.g. in order to favor some directions or in order to compensate for a non-uniform distribution of dictionary elements, we either need to apply an exponential function to the log likelihood (which is computationally expensive) as $$d_{\theta^*} = \arg\max_{d_\theta} f_{\underline{X}(l)}(\underline{X}(l); d_\theta)P(d_\theta). \tag{33}$$

$$= \arg\max_{d_\theta} e^{\mathcal{L}_\theta} P(d_\theta). \tag{34}$$

Alternatively, as the prior often is calculated off-line, it may be computationally advantageous to maximize the logarithm of the posteriori probability, i.e.

$$d_{\theta^*} = \arg\max_{d_\theta} \log\left(f_{\underline{X}(l)}(\underline{X}(l); d_\theta)P(d_\theta)\right). \tag{35}$$

$$= \arg\max_{d_\theta}(\mathcal{L}_\theta + \log P(d_\theta)). \tag{36}$$

It may be an advantage to make a joint direction decision across both hearing instruments, such that directional weights corresponding to a single estimated direction are applied to both instruments. In order to make a joint decision we can merge the likelihood functions estimated at left and right instrument, i.e.

$$\theta^* = \arg\max_\theta(\mathcal{L}_{\theta,left}, \mathcal{L}_{\theta,right}) \tag{38}$$

We may also choose to maximize the posterior probability, where each posterior probability has been normalized separately, i.e.

$$d_{\theta^*} = \arg\max_{d_\theta}\left(P(d_\theta; \underline{X}_{left}(l)), P(d_\theta; \underline{X}_{right}(l))\right) \tag{39}$$

The advantage of the above methods is that we avoid exchanging the microphone signals between the instruments. We only need to transmit the estimated likelihood functions or the normalized probabilities. Alternatively, the joint direction is estimated at the hearing instrument which has the highest estimated SNR, e.g. measured in terms of highest amount of modulation or as described in co-pending European patent application EP16190708.4 having the title A voice activity detection unit and a hearing device comprising a voice activity detection unit, and filed at the European Patent Office on 26 Sep. 2016 (published as EP3300078A1). In that case, only the local decision and the local SNR has to be exchanged between the instruments. We may as well select the local likelihood across instruments before adding the likelihoods into joint likelihood across frequency, i.e.

$$\theta^* = \arg\max_\theta\left(\sum_k \arg\max_{SNR}(\mathcal{L}_{\theta,left}(k), \mathcal{L}_{\theta,right}(k))\right) \tag{40}$$

We may select the side with the highest SNR or alternatively the side having the noise covariance matrix with the smallest determinant $|C_V(l_{0,k})|$.

Figure 1B:
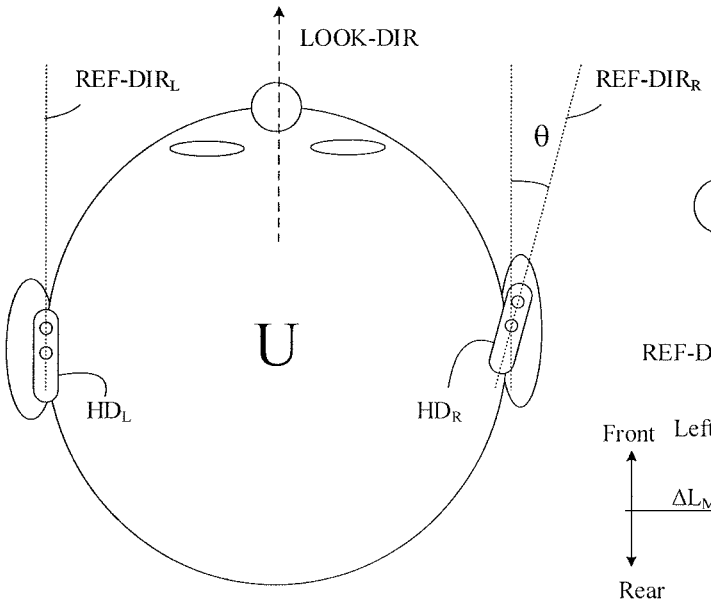
FIG. 1B shows a binaural hearing system comprising left and right hearing devices, which are differently mounted at left and right ears of a user one hearing device having its microphone axis not pointing in the look direction of the user ($\theta \neq 0$); and the other hearing device pointing in the look direction of the user.
Figure 1C:
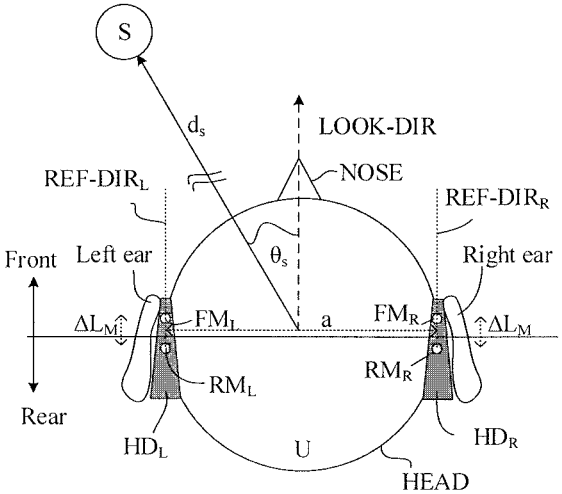
FIG. 1C schematically illustrates a typical geometrical setup of a user wearing a binaural hearing system in an environment comprising a (point) source in a front half plane of the user.

FIGS. 1A and 1B each illustrate a user (U) wearing a binaural hearing system comprising left and right hearing devices $HD_L$, $HD_R$), which are differently mounted at left and right ears of a user, in FIG. 1A one hearing device having its microphone axis pointing out of the horizontal plane (φ≠0) and in FIG. 1B one hearing device having its microphone axis not pointing in the look direction of the user (θ≠0). FIG. 1C schematically illustrates a typical geometrical setup of a user wearing a binaural hearing system comprising left and right hearing devices ($HD_L$, $HD_R$), e.g. hearing aids, in an environment comprising a (point) source (S) in a front (left) half plane of the user defined by a distance $d_s$ between the sound source (S) and the centre of the user's head (HEAD), e.g. defining a centre of a coordinate system. The user's nose (NOSE) defines a look direction (LOOK-DIR) of the user, and respective front and rear directions relative to the user are thereby defined (see arrows denoted Front and Rear in the left part of FIG. 1C). The sound source S is located at an angle $(-)\theta_s$ to the look direction of the user in a horizontal plane. The left and right hearing devices ($HD_L$, $HD_R$), are located—a distance a apart from each other—at left and right ears (Left ear, Right ear), respectively, of the user (U). Each of the left and right hearing devices ($HD_L$, $HD_R$) comprises respective front ($FM_x$) and rear ($RM_x$) microphones (x=L (left), R (right)) for picking up sounds from the environment. The front ($FM_x$) and rear ($RM_x$) microphones are located on the respective left and right hearing devices a distance $\Delta L_M$ (e.g. 10 mm) apart, and the axes formed by the centres of the two sets of microphones (when the hearing devices are mounted at the user's ears) define respective reference directions (REF-$DIR_L$, REF-$DIR_R$) of the left and right hearing devices, respectively, of FIGS. 1A, 1B and 1C. The direction to the sound source may define a common direction-of-arrival for sound received at the left and right ears of the user. The real direction-of-arrival of sound from sound source S at the left and right hearing devices will in practice be different from the one defined by arrow D (the difference being larger, the closer the source is to the user). If considered necessary, the correct angles may e.g. be determined from the geometrical setup (including angle $\theta_s$ and distance a between the hearing devices).

As illustrated in FIG. 1A, 1B, the hearing device, e.g. hearing aids, may not necessarily point towards the position corresponding to the ideal position assumed in the dictionary. The hearing aid(s) may be tilted by a certain elevation angle $\varphi$ (cf. FIG. 1A), and the hearing aids may alternatively or additionally point at a slightly different horizontal direction than anticipated (cf. angle $\theta$ in FIG. 1B). If both instruments point in the same direction, an error may lead to an estimated look vector (or steering vector) which does not correspond to the actual direction. Still, the selected look vector will be the optimal dictionary element. However, if the hearing instruments point in different directions, this has to be accounted for in order to take advantage of a joint direction-of-arrival decision at both instruments. E.g. if the left instrument is tilted compared to the right instrument, the look vector at the left instrument will—due to the smaller horizontal delay—be closer to 90 degrees compared to the right instrument. In this case directional weights representing different directions may be applied to the two instruments. Alternatively, the direction estimated at the hearing instrument having the better SNR should be applied to both instruments. Another way to take advantage of a movement sensor such as an accelerometer or a gyroscope (denoted acc in FIG. 1A) would be to take into account that the look direction will change rapidly if the head is turned. If this is detected, covariance matrices become obsolete, and should be re-estimated. An accelerometer can help determine if the instrument is tilted compared to the horizontal plane (cf. indications of accelerometer acc, and tilt angle $\varphi$ relative to the direction of the force of gravity (represented by acceleration of gravity g) in FIG. 1A on the left hearing device $HD_L$). A magnetometer may help determine if the two instruments are not pointing towards the same direction.

Examples of Implementation

FIG. 2A-2G show different graphical representations of a dictionary of relative transfer functions $d_m(k)$ representing direction-dependent acoustic transfer functions from each of said M microphones (m=1, . . . , M) to a reference microphone (m=i) among said M microphones, k being a frequency index. Each dictionary represents a limited number of look vectors.

Figure 2A:
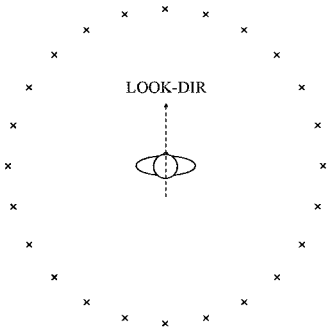
FIG. 2A-2G show seven different graphical representations of the angular distribution (over $\theta$) of dictionary elements of a dictionary of relative transfer functions $d_m(k)$ representing direction-dependent acoustic transfer functions from a target sound source to each of said M microphones ($m=1, \ldots, M$) relative to a reference microphone ($m=i$) among said M microphones, k being a frequency index, where
Figure 2B:
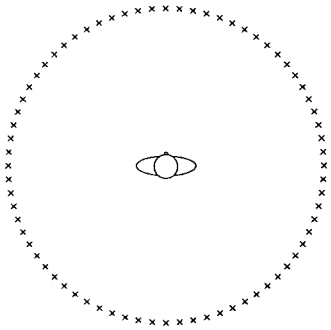
Figure 2C:
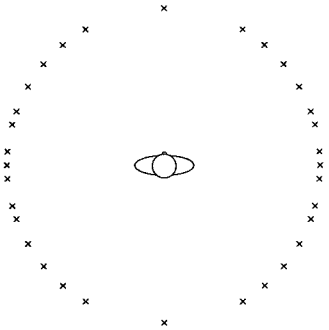
Figure 2D:
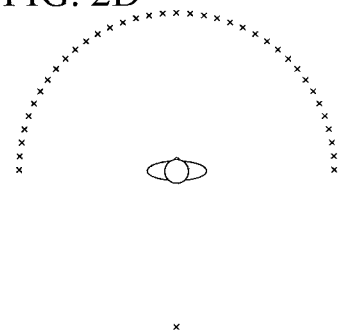
Figure 2E:
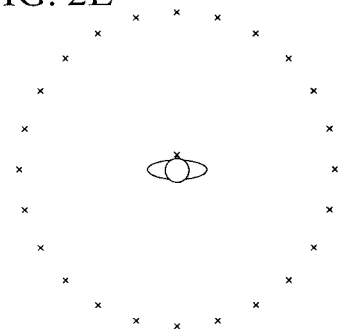
Figure 2F:
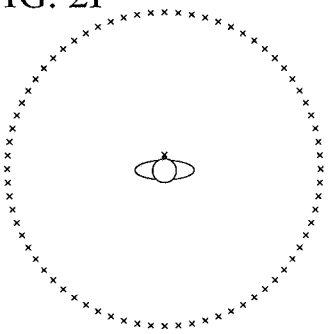
Figure 2G:
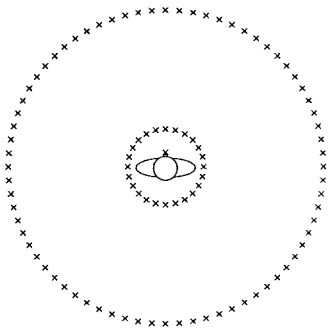

The dictionaries in FIGS. 2A and 2B show uniformly distributed look vectors in the horizontal plane with different resolution, a 15° resolution in FIG. 2A (24 dictionary elements) and a 5° resolution in FIG. 2B (72 dictionary elements). In order to save dictionary elements, dictionary elements, which are more alike could be pruned. As the look vectors towards the front direction or the back are similar, the look vectors from the front (or the back) are more tolerant towards small DOA-errors compared to look vectors from the side. For uniformly distributed dictionary elements $d_\theta$ in the horizontal plane (under free-field and far-field conditions), the delay between the front and rear microphone is proportional to $\cos(\theta)$. In order to achieve dictionary elements which are uniformly distributed with respect to microphone delay, the elements should be uniformly distributed on an arccos-scale (arccos representing the inverse cosine function). Such a distribution is shown in FIG. 2C, where the data points have been rounded to a 5° resolution. It can be noted that relatively few directions towards the front and the back relative to the sides are necessary (thereby saving computations and/or memory capacity). As most sounds-of-interest occur in the front half plane, the dictionary elements could mainly be located in the frontal half plane as shown in FIG. 2D. In order not to obtain a "random" look vector assignment, when the sound is impinging from the back, a single dictionary element representing the back is included in the dictionary as well, as illustrated in FIG. 2D. FIG. 2E and FIG. 2F, respectively are similar to FIG. 2A and FIG. 2B, but in addition to the uniformly distributed look vectors in the horizontal plane, the dictionaries also contain an "own voice" look vector. In the case of a uniform prior, each element in the dictionary is equally likely. Comparing FIGS. 2E and 2F we have a 25-element dictionary (24 horizontal directions+1 own voice direction) and a 73-element dictionary (72 horizontal directions+1 own voice direction), respectively. Assuming a flat prior in both dictionaries would favor the own voice direction in the 25-element dictionary of FIG. 2E (more than compared to the 73-element dictionary of FIG. 2F). Also in the dictionaries in FIGS. 2C and 2D, a uniform look vector would favor directions covering a broader horizontal range. Thus a prior distribution assigned to each direction is desirable. We thus typically need to apply a non-uniform prior probability to each direction as shown in Eq. (36). Including an own voice look vector may allow us to use the framework for own voice detection. Dictionary elements may as well be individualized or partly estimated during usage. E.g. the own voice look vector may be estimated during use as described in EP2882204A1. As the relative transfer function near the user may differ from the relative transfer function further away from the user, the dictionary may also contain relative transfer functions measured at different distances from the user (different locations) as illustrated in FIG. 2G. Also transfer functions from different elevation angles may be part of the dictionary (not shown), cf. e.g. angle $\varphi$ in FIG. 1A.

In miniature hearing devices, e.g. hearing aids, size and power consumption are important limiting factors. Hence computational complexity is preferably avoided or minimized. In embodiments of the present scheme, computations can be reduced by Down sampling Reducing the number of dictionary elements Reducing the number of frequency channels Removing terms in the likelihood function with low importance The data of FIG. 3A, 3B, 3C are intended to show that the likelihood can be evaluated for different dictionary elements, and the outcome (maximum) of the likelihood depends on the selected subset of dictionary elements.

Figure 3A:
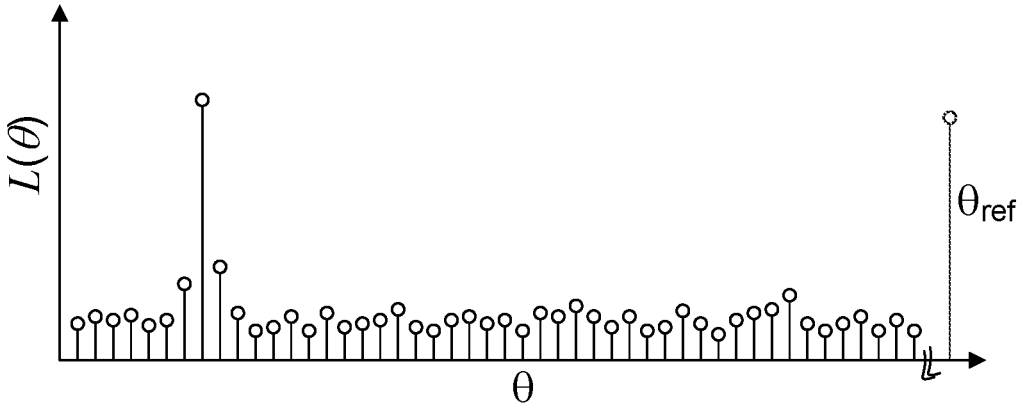
FIG. 3A shows a log likelihood function evaluated over all dictionary elements for a first input signal.

FIG. 3A shows a log likelihood function L(θ) of look vectors evaluated over all dictionary elements θ. In addition, a reference element, denoted $\theta_{ref}$, has been estimated directly from the microphone signals (or by other means). The likelihood value of the reference element $\theta_{ref}$ is indicated in the same scale as the dictionary elements, whereas its location on the angle scale θ is arbitrary (as indicated by the symbolic disruption '∬' of the horizontal θ-axis). The reference look vector $d_{\theta ref}$ is assumed to be close to the maximum value of the likelihood function. This reference look vector becomes useful in the case, where the dictionary only contains very few elements (cf. e.g. FIG. 3B). With only few elements in the dictionary, none of the elements may be close to the optimal look direction albeit one of the elements still has a maximum value among the dictionary elements. By comparing the maximum to the maximum of the reference element $\theta_{ref}$, it becomes possible to determine if the maximum among the dictionary also qualifies as a global maximum.

Figure 3B:
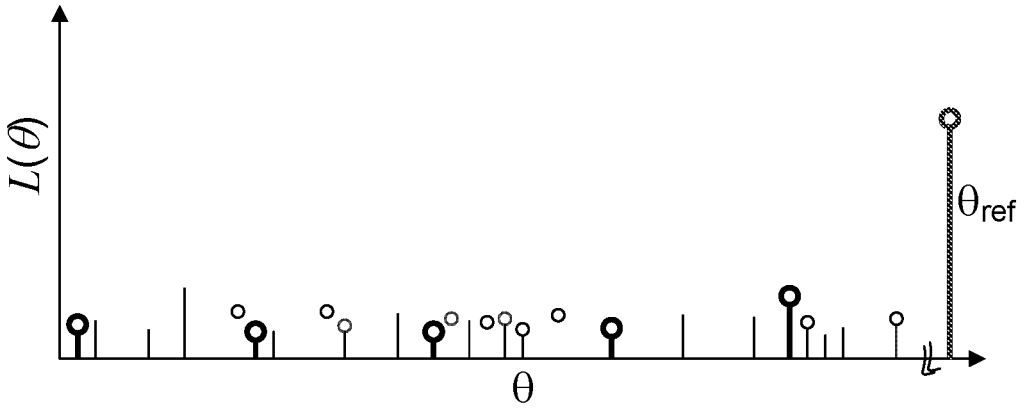
FIG. 3B shows a log likelihood function evaluated over a first selection of dictionary elements for a second input signal.
Figure 3C:
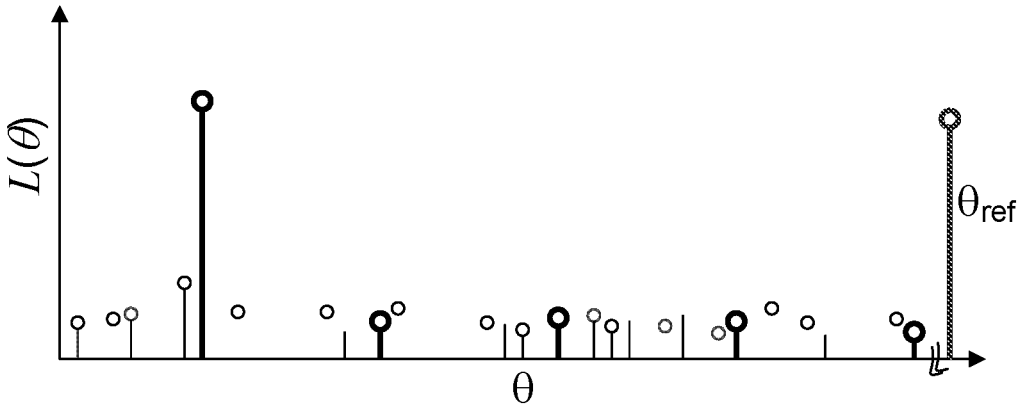
FIG. 3C shows a log likelihood function evaluated over a second selection of dictionary elements for a third input signal.
Figure 5A:
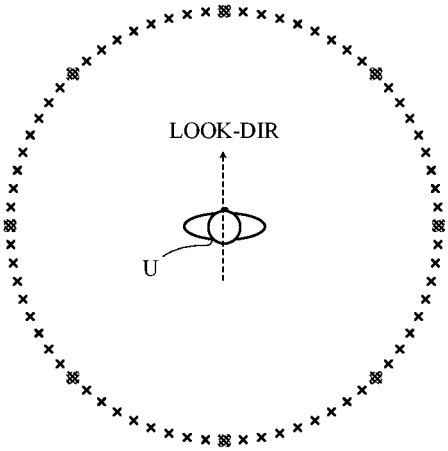
FIGS. 5A and 5B illustrate a two-step procedure for evaluating the likelihood function of a limited number or dictionary elements, FIG. 5A illustrating a first evaluation of a uniformly distributed subset of the dictionary elements, and FIG. 5B illustrating a second evaluation of a subset of dictionary elements, which are close to the most likely values obtained from the first evaluation and more densely represented.
Figure 5A:
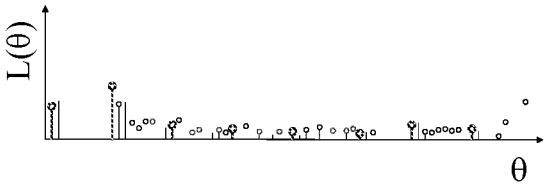
Figure 5B:
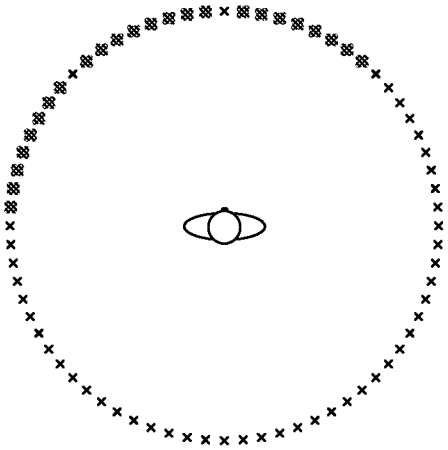
Figure 5B:
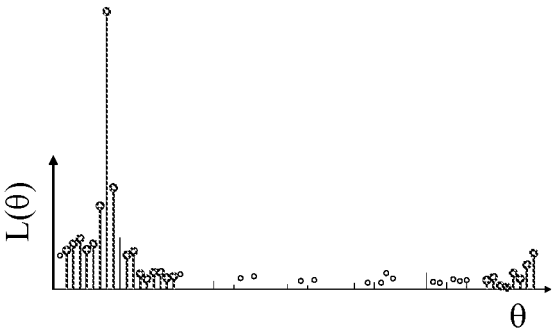

FIG. 3B illustrates the case, where none of the sparse dictionary elements indicated by solid vertical lines in a 'background' of dotted vertical lines are close to the maximum of the likelihood function. A resulting θ-value may be estimated based on the reference value (as illustrated in FIG. 5A, 5B) by selecting a sub-range of θ-values in a range around the reference value $\theta_{ref}$ for a more thorough investigation (with a larger density of θ-values). FIG. 3C illustrates the case, where one of the sparse dictionary elements qualifies as a global maximum of the likelihood function as it is close to the likelihood value of the estimated reference look vector. The dotted elements in FIGS. 3B and 3C—indicated for the sake of comparison with FIG. 3A—represent non-evaluated (e.g. at the present time), or non-existing elements in the dictionary.

In an embodiment, a reference direction of arrival $\theta_{ref}$ may be determined from the microphone signals as discussed in our co-pending European patent application no. EP16190708.4 (published as EP3300078A1).

Figure 4A:
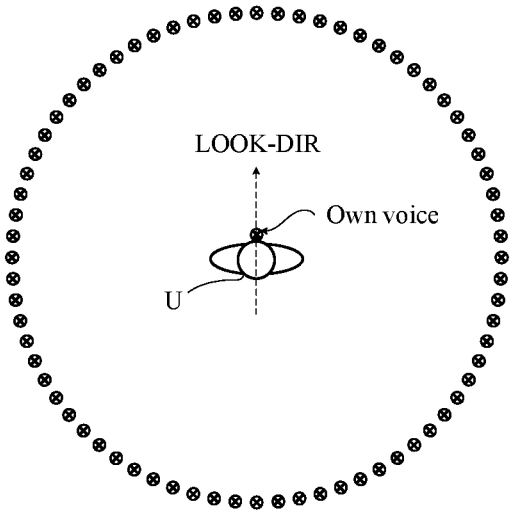
FIG. 4A shows a first graphical representation of a dictionary of relative transfer functions $d_m(k)$ where all elements in the dictionary have been evaluated in both sides of the head of a user (e.g. both hearing instruments)
Figure 4B:
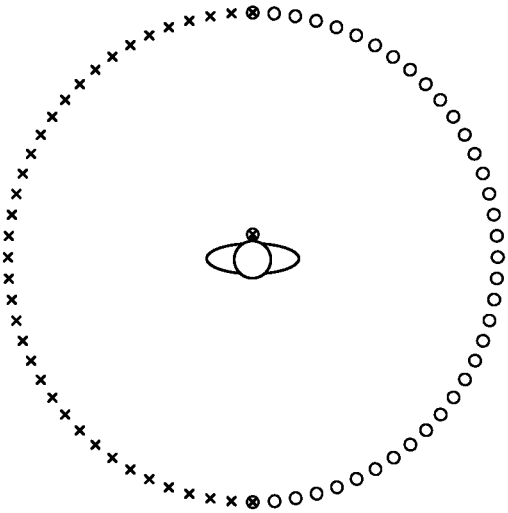
FIG. 4B shows a second graphical representation of a dictionary of relative transfer functions $d_m(k)$ where calculations are divided between the two sides of the head of a user (e.g. hearing instruments) such that only the log likelihood function of the dictionary elements related to the non-shadow side of the head relative to the target sound source is evaluated.

FIG. 4A illustrates the case, where all elements in the dictionary of relative transfer functions $d_m(k)$ have been evaluated in both the left and the right instrument. The look vectors evaluated in the left instrument are denoted by x, and the look vectors evaluated in the right instrument are denoted by ○. The coinciding symbols ○ and x indicates that the element is part of dictionaries of the left as well as the right hearing instrument. To illustrate the angular distribution of dictionary elements, the user (U) is shown at the center of a circle wherein the dictionary elements are uniformly distributed. A look direction (LOOK-DIR) of the user (U) is indicated by the dashed arrow. Additional dictionary elements representing relative transfer functions from the user's mouth, denoted Own voice, are located immediately in front of the user (U). The same legend is assumed in FIGS. 4B, 5A and 5B. In order to save memory as well as computations, each hearing instrument may limit its computations to the "sunny" side of the head. The sunny side will typically have the best signal to noise ratio, and hereby the best estimate (because it refers to the side (or half- or quarter-plane) relative to the user comprising the active target sound source). In FIG. 4B the calculations are divided between the instruments such that only the log likelihood function of the dictionary elements of relative transfer functions $d_m(k)$ related to the non-shadow side of the head is evaluated (at a given ear, e.g. in a given hearing device). The likelihood functions may afterwards be combined in order to find the most likely direction. Alternatively, the likelihood of a reference look vector may be evaluated (as e.g. illustrated in FIG. 3A, 3B, 3C) in order to determine if the sunny side is among the left look vector elements or among the right elements. Another option is to normalize the joint likelihood function e.g. by assigning the same value to one of the look vectors which have been evaluated at both instruments (i.e. front, back or own voice).

FIG. 5A-5B illustrates an exemplary two step procedure for evaluating the likelihood function of a limited number or dictionary elements, FIG. 5A illustrating a first evaluation of a uniformly distributed subset of the dictionary elements, and FIG. 5B illustrating a second evaluation of a subset of dictionary elements, which are close to the most likely values obtained from the first evaluation (thereby providing a finer resolution of the most probable range of values of θ). In each of FIGS. 5A and 5B, the left part illustrates the angular distribution and density of dictionary elements around the user (as in FIG. 2A-2G), whereas the right part shows an exemplary log likelihood function (at a given time) for all dictionary elements as vertical solid lines with an 'o' at the top, the length of the line representing the magnitude of the likelihood function (as in FIG. 3A-3C).

The method of reducing the number of dictionary elements to be evaluated performs the evaluation sequentially (as illustrated in FIGS. 5A and 5B). Initially, the likelihood is evaluated at a few points (low angular resolution, cf. FIG. 5A) in order to obtain a rough estimation of the most likely directions. Based on this estimate, the likelihood is evaluated with another subset of dictionary elements, which are close to the most likely values obtained from the initial evaluation (e.g. so that the most likely directions are evaluated with a higher angular resolution, cf. FIG. 5B). Hereby the likelihood function may be evaluated with a high resolution without evaluating all dictionary elements. In principle, the evaluation may take place in even more steps. Applying such a sequential evaluation may save computations as unlikely directions are only evaluated with a low angular resolution and only likely directions are evaluated with a high angular resolution. In an embodiment the subset of dictionary elements is aligned between left and right hearing instruments.

It should be emphasized that even though a given dictionary element exists in both hearing instruments, the value of the element depends on the exact location of the microphones relative to the sound source (the likelihood value may thus differ between the dictionaries of the respective hearing instruments).

Another way to reduce the complexity is to apply the log likelihood in fewer channels. Fewer channels not only saves computations, it also saves memory as fewer look vectors need to be stored.

Figure 6:
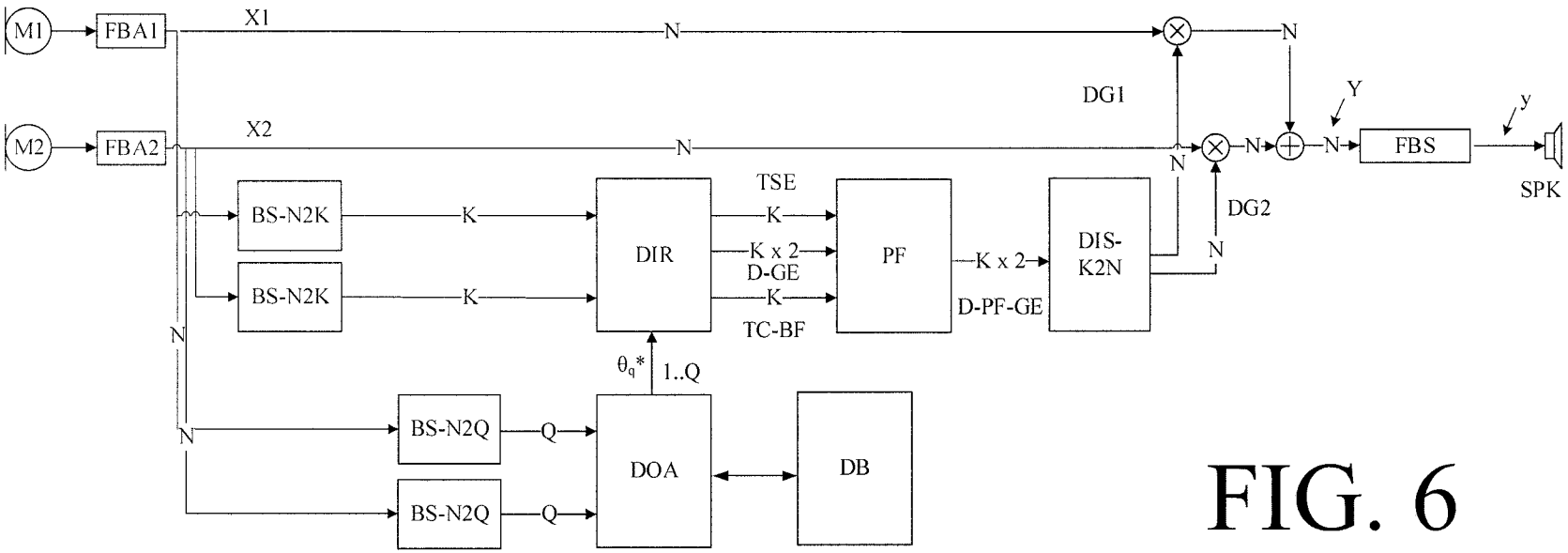
FIG. 6 shows a hearing device according to a first embodiment of the present disclosure.

FIG. 6 shows a hearing device comprising a directional microphone system according to a first embodiment of the present disclosure. The hearing device comprises a forward path for propagating an audio signal from a number of input transducers (here two microphones, M1, M2) to an output transducer (here loudspeaker, SPK), and an analysis path for providing spatial filtering and noise reduction of the signals of the forward path.

Figure 12:
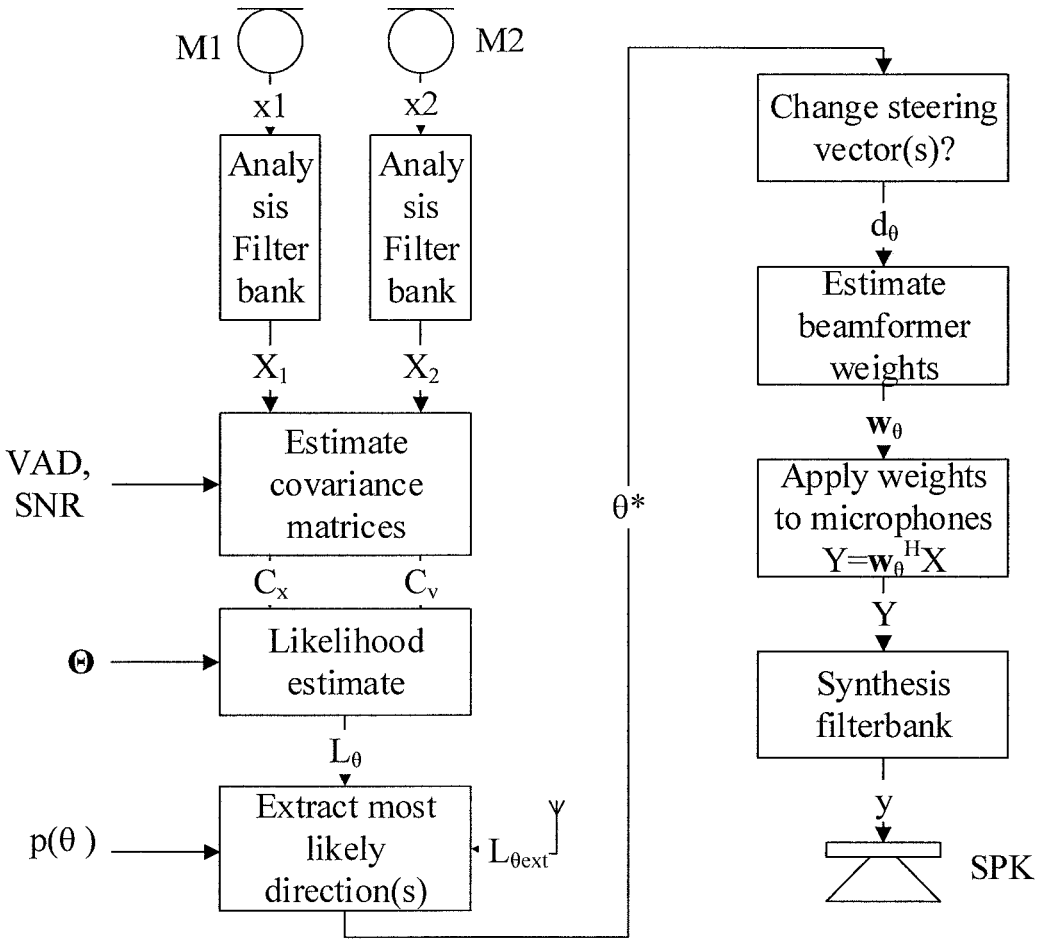
FIG. 12 shows a schematic flow diagram for estimating a beamformed signal in a forward path of a hearing device according to the present disclosure.

The forward path comprises two microphones (M1, M2) for picking up input sound from the environment and providing respective electric input signals representing sound (cf. e.g. (digitized) time domain signals x1, x2 in FIG. 12). The forward further comprises respective analysis filter banks (FBA1, FBA2) for providing the respective electric input signals in a time frequency representation as a number N of frequency sub-band signals (cf. e.g. signals X1, X2).

The analysis path comprises a multi-input beamformer and noise reduction system according to the present disclosure comprising a beamformer filtering unit (DIR), a (location or) direction of arrival estimation unit (DOA), a dictionary (DB) of relative transfer functions, and a post filter (PF). The multi-input beamformer and noise reduction system provides respective resulting directional gains (DG1, DG2) for application to the respective frequency sub-band signals (X1, X2).

The resulting directional gains (DG1, DG2) are applied to the respective frequency sub-band signals (X1, X2) in respective combination units (multiplication units 'x') in the forward path providing respective noise reduced input signals, which are combined in combination unit (here sum unit '+' providing summation) in the forward path. The output of the sum unit '+' is the resulting beamformed (frequency sub-band) signal Y. The forward path further comprises a synthesis filter bank (FBS) for converting the frequency sub-band signal Y to a time-domain signal y. The time-domain signal y is fed to loudspeaker a (SPK) for conversion to an output sound signal originating from the input sound. The forward path comprises N frequency sub-band signals between the analysis and synthesis filter banks. The forward path (or the analysis path) may comprise further processing units, e.g. for applying frequency and level dependent gain to compensate for a user's hearing impairment.

The analysis path comprises respective frequency sub-band merging and distribution units for allowing signals of the forward path to be processed in a reduced number of sub-bands. The analysis path is further split in two parts, operating on different numbers of frequency sub-bands, the beamformer post filter path (comprising DIR and PF units) operating on electric input signals in K frequency bands and the location estimation path (comprising DOA and DB units) operating on electric input signals in Q frequency bands.

The beamformer post filter path comprises respective frequency sub-band merging units, e.g. bandsum units (BS-N2K), for merging N frequency sub-bands into K frequency sub-bands (K<N) to provide respective microphone signals (X1, X2) in K frequency sub-bands to the beamformer filtering unit (DIR), and a distribution unit DIS-K2N for distributing K frequency sub-bands to N frequency sub-bands.

The location estimation path comprises respective frequency sub-band merging units, e.g. bandsum units (BS-N2Q), for merging N frequency sub-bands into Q frequency sub-bands (Q<N) to provide respective microphone signals (X1, X2) in Q frequency sub-bands to the location or direction of arrival estimation unit (DOA). Based thereon, the location or direction of arrival estimation unit (DOA) estimates a number $N_{ML}$ of the most likely locations of or directions to (cf. signal $\theta_q$*, q=1, . . . , $N_{ML}$, where $N_{ML}$ is ≥1) a current sound source based on the dictionary or relative transfer functions stored in a database (DB) using a maximum likelihood method according to the present disclosure. The one or more of the most likely locations of or directions to a current sound source (cf. signal $\theta_q$*) is/are each provided in a number of frequency sub-bands (e.g. Q) or provided as one frequency-independent value (hence indication '1 . . . Q' at signal $\theta_q$* in FIG. 6). The signal(s) $\theta_q$* is/are fed to the beamformer filtering unit (DIR), where it is used together with inputs signals X1, X2 in K frequency sub-bands to determine frequency dependent beamformer filtering weights (D-GE (Kx2)) representing weights $w_{\theta 1}$ and $w_{\theta 2}$, respectively, configured to after further noise reduction in the post filter (PF)—be applied to the respective electric input signals (X1, X2) in the forward path. The beamformer filtering unit (DIR) is further configured to create resulting beamformed signals, target maintaining signal TSE, and target cancelling signal TC-BF. The signals TSE, TC-BF and beamformer filtering weights D-GE, are fed to post filter (PF) for providing further noise reduced frequency dependent beamformer filtering weights D-PF-GE (Kx2) configured to after conversion from K to N bands—be applied to the respective electric input signals (X1, X2) in the forward path. The post filter (PF) applies time dependent scaling factors to the beamformer filtering weights D-GE ($w_{\theta 1}$ and $w_{\theta 2}$), in dependence of a signal to noise ratio (SNR) of the individual time frequency units of the target maintaining and target cancelling signals (TSE, TC-BF). In an embodiment, Q<N. In an embodiment, K<N. In an embodiment, Q≤K. In an embodiment, Q<K<N. In an embodiment, N is equal to 64 or 128 or more. In an embodiment, K is equal to 16 or 32 or more. In an embodiment, Q is equal to 4 or 8 or more. In an embodiment, the Q frequency sub-bands cover only a sub-range of the frequency range of operation covered by the N frequency bands of the forward path.

In the embodiment of a hearing device shown in FIG. 6, the likelihood function for estimation of position or direction-of-arrival (unit DOA) is calculated in frequency channels, which are merged into a single likelihood estimate L across all frequency channels. The likelihood functions is thus estimated in a different number of frequency channels Q compared to the number of frequency channels K which are used in the directional system (beamformer) and/or noise reduction system.

The embodiment of a hearing device according to FIG. 6 comprises first and second microphones (M1, M2) for picking up sound from the environment and converting the sound to respective first and second electric signals (possibly in digitized form). The first and second microphones are coupled to respective analysis filter banks (AFB1, AFB2) for providing the (digitized) first and second electric signals in a number N of frequency sub-band signals.

The target look direction is an updated position estimate based on the direction-of-arrival (DOA) estimation. Typically, the directional system runs in fewer channels (K) than the number of frequency bands (N) from the analysis filterbank. As the target position estimation is independent of the frequency resolution of the directional system, we may apply the likelihood estimate in even fewer bands, and we may thus apply the calculation in even fewer bands.

Figure 7:
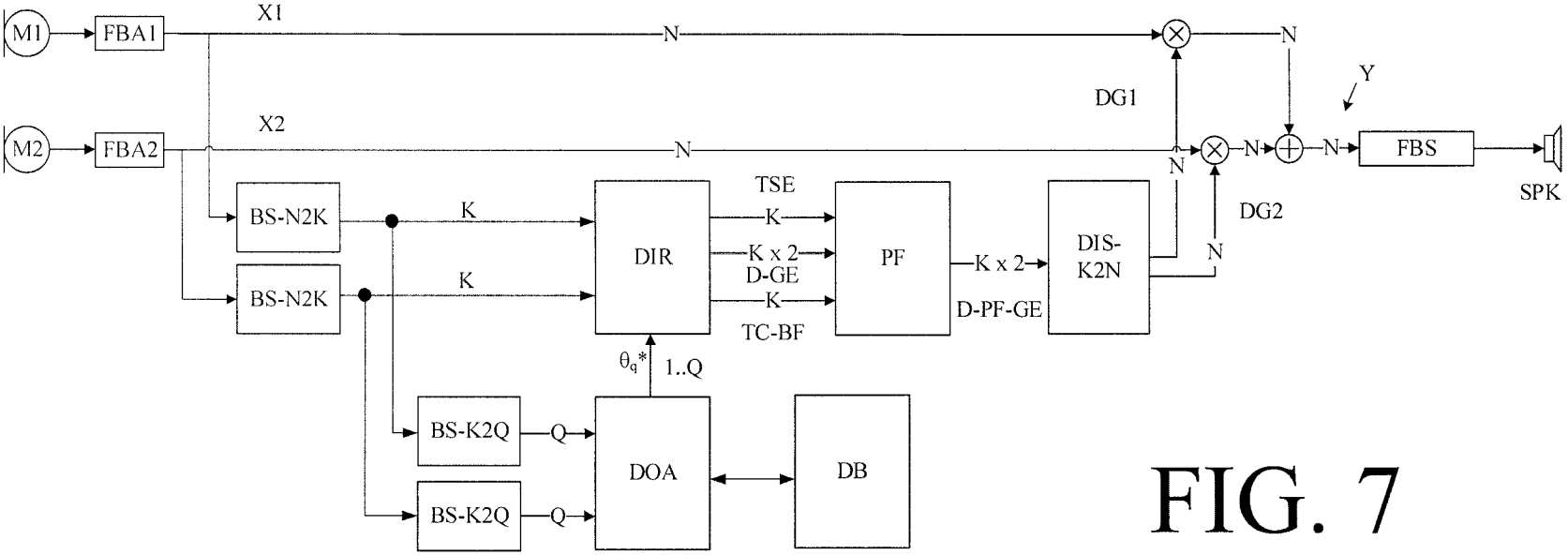
FIG. 7 shows a hearing device according to a second embodiment of the present disclosure.

One way of obtaining Q bands is to merge some of the K frequency channels into Q channels as shown in FIG. 7. FIG. 7 shows a hearing device according to a second embodiment of the present disclosure. The hearing device of FIG. 7 comprises the same functional units as the hearing device of FIG. 6. As in FIG. 6 the likelihood functions are estimated in a different number of frequency channels Q compared to the number of frequency channels K which are used in the noise reduction system. Contrary to the embodiment of FIG. 6, where the K and the Q frequency channels were obtained by merging the original N frequency bands, the Q channels in FIG. 7 are obtained by merging the K channels into Q channels.

In an embodiment, only channels in a low frequency range are evaluated. Hereby we may use a dictionary, based on a free field model. Such that e.g. all elements only contain a delay. Given by d/c cos(θ), where d is the distance between the microphones in each instrument, and c is the speed of sound. Hereby all dictionary elements may be calculated based on a calibration, where the maximum delay has been estimated. The delay may be estimated off-line or online e.g. based on a histogram distribution of measured delays.

It can be shown that merging the original e.g. 16 bands into fewer bands affects the shape of the likelihood function for a sound impinging from 180 degrees in a diffuse noise field. In addition, it may be advantageous not to include the higher frequency channels as the relative transfer functions in the highest channels varies across individuals as well we see variation due to slightly different placement when the instrument is re-mounted at the ear. Having separate channels for the DOA estimation and the noise reduction system requires more memory. Some memory allocation is required for dictionary weights as well as well as the corresponding directional weights. Considerations on memory allocation in the case of 2 microphones is illustrated in FIG. 8.

Figure 8:
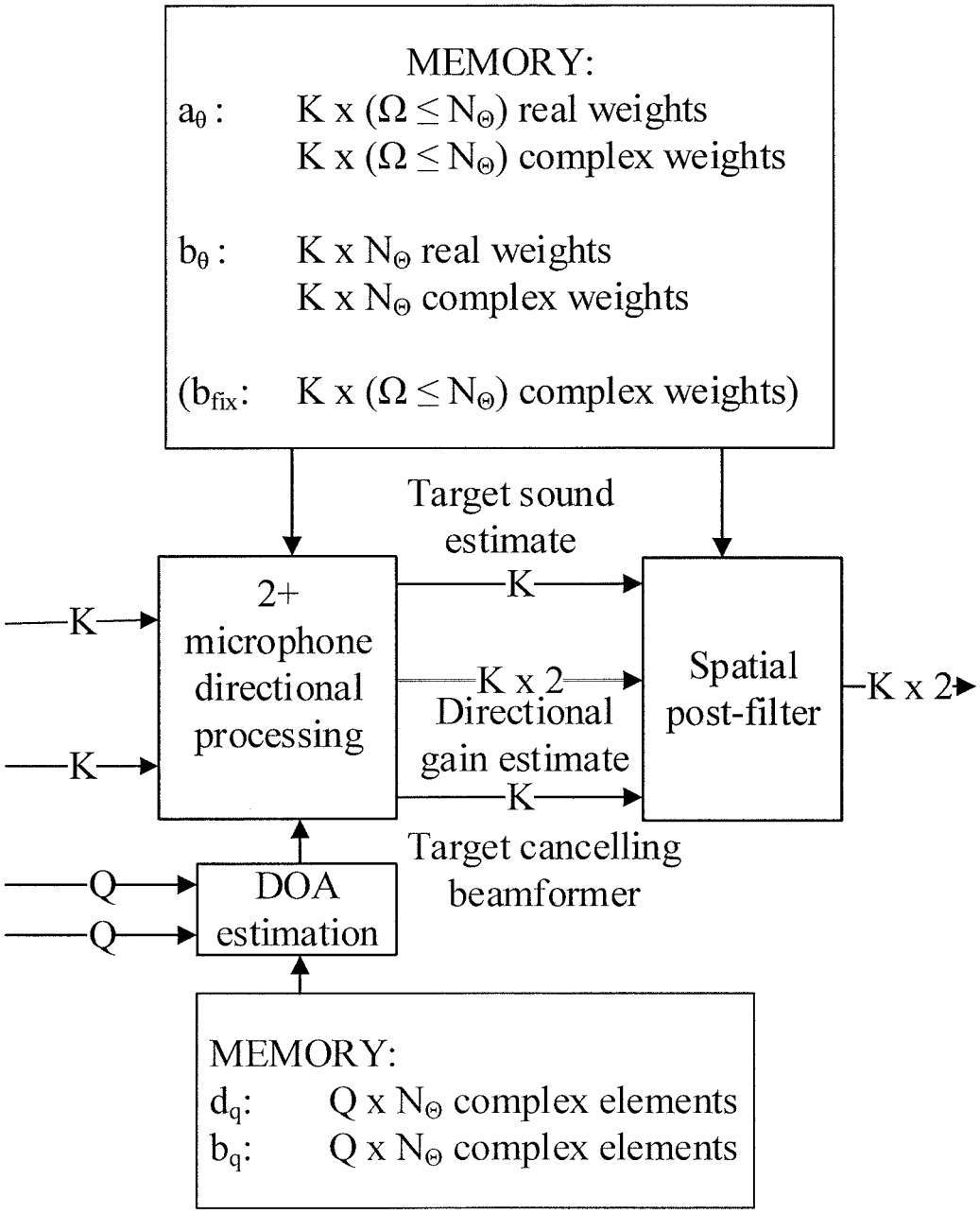
FIG. 8 shows an exemplary memory allocation of dictionary elements and weights for a microphone system comprising two microphones according to the present disclosure.

FIG. 8 shows an exemplary memory allocation of dictionary elements and weights for a microphone system comprising two microphones according to the present disclosure.

First considering the DOA estimation, the look vector $d=[d_1\ d_2]^T$ should be stored as well as the corresponding target canceling beamformer weight $b_\theta=[b_1\ b_2]^T$. As $d_1=1$ and we may scale $b_\theta$ as we like, each of the directional elements $d_\theta$ and $b_\theta$ require one complex number per channel Q, in total $2\times Q\times N_\Theta$ real values. In principle $b_\theta$ can be calculated from $d_\theta$, but in most cases it is an advantage to store $b_\theta$ in the memory rather than re-calculating $b_\theta$ each time. Directional weights corresponding to the dictionary elements also need to be stored. If $K\neq Q$, separate weights are required. In principle, all directional weights can be obtained directly from the look vector $d_\theta$, but as the same weights have to be calculated continuously, it is advantageous to pre-store all the necessary weights. If we implement the MVDR beamformer directly, we can obtain the weights directly from the look vector $d_\theta$, as in Eq. (9)

$$w_\theta = \frac{C_V^{-1} d_\theta}{d_\theta^H C_V^{-1} d_\theta}. \tag{9}$$

It should be noted that the estimate of $C_v$ used in the MVDR beamformer may be different from the estimate of $C_v$ used in the ML DOA estimation as different smoothing time constants may be optimal for DOA estimation and for noise reduction.

In the two-microphone case, if the MVDR beamformer is implemented via the GSC structure, we need the fixed weights $a_\theta$ of the omnidirectional beamformer as well as its corresponding target canceling beamformer weights $b_\theta$ such that $$w_\theta=a_\theta-\beta^* b_\theta \tag{41}$$

where * denotes complex conjugation and β is an adaptive parameter estimated as $$\beta = \frac{a_\theta^H C_V b_\theta}{b_\theta^H C_V b_\theta}. \tag{42}$$

Notice that $a_\theta \propto d_\theta$. In this case, we need to store $a_\theta=[a_1\ a_2]$ along with the target canceling beamformer weights and (optionally) a set of fixed values $\beta_{fix}$ for obtaining fixed beamformer weights. As the MVDR beamformer is less sensitive to angular resolution, we may only store a smaller number Ω of weights $a_\theta$ than the number of dictionary elements. But as the target canceling beamformer weights also may have to be used in connection with a ('spatial') post filter (cf. e.g. FIG. 8), the target canceling beamformer weights should preferably be stored with the same number of weights as the number of dictionary elements.

Recall the Likelihood Function $$\mathcal{L}_{\theta,M=2}(l) \propto -\log\left\{\frac{w_\theta^H(l)\hat{C}_X(l)w_\theta(l)}{w_\theta^H(l)\hat{C}_V(l_0)w_\theta(l)}\right\} - \log\left\{\frac{b_\theta^H\hat{C}_X(l)b_\theta}{b_\theta^H\hat{C}_V(l_0)b_\theta}\right\} - \log|C_V(l_0)|. \tag{17}$$

We notice that some of the terms (only depending on $l_0$) only are updated, when speech is not present. We may thus save some computations as some of the terms only need to be updated in absence of speech. As the direction only needs to be updated in the presence of speech, we may choose only to update other terms of the likelihood during presence of speech. Furthermore, to save computations, we may also choose to omit some of the terms in the likelihood function as not all terms have equal weight. E.g. we may estimate the likelihood as $$\mathcal{L}_{\theta,M=2}(l) \propto -\log\left\{\frac{b_\theta^H\hat{C}_X(l)b_\theta}{b_\theta^H\hat{C}_V(l_0)b_\theta}\right\}. \tag{43}$$

Obtaining a Stable Estimate of Direction

As the change of look vector may lead to audible changes in the resulting beamformer, one should avoid too frequent changes of look direction θ. Audible changes caused by the signal processing is typically not desirable. In order to achieve stable estimates, the smoothing time constants of the covariance matrix estimated may be adjusted (cf. the mention of adaptive covariance matrix smoothing below). Furthermore, we may e.g. by modifying the prior probability assign a higher probability to the currently estimated direction. Smoothing across time may also be implemented in terms of a histogram, counting the most likely direction. The histogram may be used to adjust the prior probability. Also, in order to reduce change of direction, changes should only be allowed, if the likelihood of the current direction has become unlikely. Besides smoothing across frequency, we may also apply smoothing across direction such that nearby directions become more likely. In an embodiment, the microphone system is configured to fade between an old look vector estimate and a new look vector estimate (to avoid sudden changes that may create artefacts). Other factors which may lead to errors in the likelihood estimate is feedback. If a feedback path in some frequency channels dominate the signal, it may also influence the likelihood. In the case of a high amount of feedback in a frequency channel, the frequency channel should not be taken into account when the joint likelihood across frequency is estimated, i.e.

$$\theta^* = \underset{\theta}{\operatorname{argmax}} \sum_k \rho_k \mathcal{L}_{\theta,k}, \tag{44}$$

where $\rho_k$ is a weighting function between 0 and 1, which is close to or equal to 1 in case of no feedback and close to or equal to 0 in case of a high amount of feedback. In an embodiment, the weighting function is given in a logarithmic scale.

FIG. 12 illustrates an embodiment of the processing flow for providing a beamformed signal in a forward path of a hearing device according to the present disclosure. Input transducers (Microphones M1, M2) pick up sound from the environment and provide time domain (e.g. digitized) signals (x1, x2). Each microphone signal (x1, x2) is converted into a frequency domain by the Analysis Filterbank. In each frequency channel k, the covariance matrices $C_x$ and $C_v$ are estimated and updated based on a voice activity estimate and/or an SNR estimate. The covariance matrices are used to estimate the likelihood function of some or all of the elements in the dictionary Θ, cf. block Likelihood estimate. The evaluated likelihood function $L_\theta$ (and possibly prior information p(θ) on the dictionary elements) are used to find the most likely direction or the most likely directions, cf, block Extract most likely direction(s). In an embodiment, where an own voice dictionary element is included in the likelihood calculation, an 'own voice flag' may be provided by the Extract most likely direction(s) block, e.g. for use in the algorithm of the present disclosure in connection with update of covariance matrices or by other algorithms or units of the device. The estimated direction θ* may be found as a single direction across all frequency channels as well as based on the estimated likelihood $L_{\theta ext}$ of the other instrument (e.g. of a binaural hearing aid system, cf. antenna symbol denoted $L_{\theta ext}$). Based on the estimated directions, it is determined if the steering vector $d_\theta$ (or look direction) should be updated, cf. block Change steering vector(s)?. Based on the steering vector $d_\theta$, the beamformer weights $w_\theta$, are estimated, cf. block Estimate beamformer weights, and applied to the microphone signals (possibly in connection with other gain contributions, cf. block Apply weights to microphones $Y=w_\theta^H X$) to provide a resulting beamformed signal Y. The beamformed signal Y is fed to a Synthesis filterbank providing resulting time domain signal y. The synthesized signal y is presented to the listener by output transducer (SPK).

The block Estimate beamformer weights needs the noise covariance matrix $C_v$ as input for providing beamformer weight estimates, cf. e.g. eq. (9) or e.q. (41), (42). It should be noted that noise covariance matrices $C_v$ used for providing beamforming may be differently estimated (different time constants, smoothing) than those used for the DoA estimate.

A Method of Adaptive Covariance Matrix Smoothing for Accurate Target Estimation and Tracking.

In a further aspect of the present disclosure, a method of adaptively smoothing covariance matrices is outlined in the following. A particular use of the scheme is for (adaptively) estimating a direction of arrival of sound from a target sound source to a person (e.g. a user of a hearing aid, e.g. a hearing aid according to the present disclosure). The scheme may be advantageous in environments or situations where a direction to a sound source of interest changes dynamically over time.

The method is exemplified as an alternative (or additional) scheme for smoothing of the covariance matrices $C_x$ and $C_v$ (used in DoA estimation) compared to the SNR based smoothing outlined above in connection with FIGS. 10 and 11A-11F.

The adaptive covariance matrix scheme is described in our co-pending European patent application no. EP17173422.1 filed with the EPO on 30 May 2017 having the title "A hearing aid comprising a beam former filtering unit comprising a smoothing unit" (published as EP3253075A1).

Signal Model:

We consider the following signal model of the signal x impinging on the $i^{th}$ microphone of a microphone array consisting of M microphones:

$$x_i(n)=s_i(n)+v_i(n), \tag{101}$$

where s is the target signal, v is the noise signal, and n denotes the time sample index. The corresponding vector notation is $$x(n)=s_i(n)+v(n), \tag{102}$$

where $x(n)=[x_1(n); x_2(n), \ldots, x_M(n)]^T$. In the following, we consider the signal model in the time frequency domain. The corresponding model is thus given by $$X(k,m)=S(k,m)+V(k,m), \tag{103}$$

where k denotes the frequency channel index and m denotes the time frame index. Likewise $X(k,m)=[X_1(k,m), X_2(k,m), \ldots, X_M(k,m)]^T$. The signal at the $i^{th}$ microphone, $x_i$ is a linear mixture of the target signal $s_i$ and the noise $v_i$. $v_i$ is the sum of all noise contributions from different directions as well as microphone noise. The target signal at the reference microphone $s_{ref}$ is given by the target signal s convolved by the acoustic transfer function h between the target location and the location of the reference microphone. The target signal at the other microphones is thus given by the target signal at the reference microphone convolved by the relative transfer function $d=[1, d_2, \ldots, d_M]^T$ between the microphones, i.e. $s_i=s*h*d_i$. The relative transfer function d depends on the location of the target signal. As this is typically the direction of interest, we term d the look vector (cf. $d(l)=d'(l)/d'_i(l)$, as previously defined). At each frequency channel, we thus define a target power spectral density $\sigma_s^2(k,m)$ at the reference microphone, i.e.

$$\sigma_s^2(k,m)=\langle |S(k,m)H(k,m)|^2\rangle=\langle |S(k,m)_{ref}|^2\rangle, \tag{104}$$

where ⟨•⟩ denotes the expected value. Likewise, the noise spectral power density at the reference microphone is given by $$\sigma_v^2(k,m)=\langle |V(k,m)_{ref}|^2\rangle, \tag{105}$$

The inter-microphone cross-spectral covariance matrix at the $k^{th}$ frequency channel for the clean signal s is then given by $$C_s(k,m)=\sigma_s^2(k,m)d(k,m)d^H(k,m), \tag{106}$$

where H denotes Hermitian transposition. We notice the M×M matrix $C_s(k,m)$ is a rank 1 matrix, as each column of $C_s(k,m)$ is proportional to d(k,m). Similarly, the inter-microphone cross-power spectral density matrix of the noise signal impinging on the microphone array is given by, $$C_v(k,m)=\sigma_v^2(k,m)\Gamma(k,m_0), m>m_0, \tag{107}$$

where $\Gamma(k,m_0)$ is the M×M noise covariance matrix of the noise, measured some time in the past (frame index $m_0$). Since all operations are identical for each frequency channel index, we skip the frequency index k for notational convenience wherever possible in the following. Likewise, we skip the time frame index m, when possible. The inter-microphone cross-power spectral density matrix of the noisy signal is then given by $$C=C_s+C_v \tag{108}$$

$$C=\sigma_s^2 dd^H+\sigma_v^2\Gamma \tag{109}$$

where the target and noise signals are assumed to be uncorrelated (where $\sigma_s^2$ and $\sigma_v^2$ correspond to the power spectral densities (psd) of the target signal) $\lambda_S(l)$ and the noise signal $\lambda_V(l)$, respectively, as previously defined). The fact that the first term describing the target signal, $C_s$, is a rank-one matrix implies that the beneficial part (i.e., the target part) of the speech signal is assumed to be coherent/directional. Parts of the speech signal, which are not beneficial, (e.g., signal components due to late-reverberation, which are typically incoherent, i.e., arrive from many simultaneous directions) are captured by the second term.

Covariance Matrix Estimation

A look vector estimate can be found efficiently in the case of only two microphones based on estimates of the noisy input covariance matrix and the noise only covariance matrix. We select the first microphone as our reference microphone. Our noisy covariance matrix estimate is given by $$\hat{C} = \begin{bmatrix} \hat{C}_{x11} & \hat{C}_{x12} \\ \hat{C}_{x12}^* & \hat{C}_{x22} \end{bmatrix} \tag{110}$$

where * denotes complex conjugate. Each element of our noisy covariance matrix is estimated by low-pass filtering the outer product of the input signal, $XX^H$. We estimate each element by a first order IIR low-pass filter with the smoothing factor $\alpha \epsilon [0; 1]$, i.e.

$$\hat{C}_x(m) = \begin{cases} \alpha \hat{C}_x(m-1) + (1-\alpha)X(m)X(m)^H, \text{Target present} \\ \gamma \hat{C}_x(m-1) + (1-\gamma)\hat{C}_{no}, \text{Otherwise} \end{cases}; \tag{111}$$

We thus need to low-pass filter four different values (two real and one complex value), i.e. $\hat{C}_{x11}(m)$, $Re\{\hat{C}_{x12}(m)\}$, $Im\{\hat{C}_{x12}(m)\}$, and $\hat{C}_{x22}(m)$. We don't need $\hat{C}_{x21}(m)$ since $\hat{C}_{x21}(m)=\hat{C}^*_{x12}$. It is assumed that the target location does not change dramatically in speech pauses, i.e. it is beneficial to keep target information from previous speech periods using a slow time constant giving accurate estimates. This means that $\hat{C}_x$ is not always updated with the same time constant and does not converge to $\hat{C}_v$ in speech pauses, which is normally the case. In long periods with speech absence, the estimate will (very slowly) converge towards to $C_{no}$ using a smoothing factor close to one. The covariance matrix $C_{no}$ could represent a situation where the target DOA is zero degrees (front direction), such that the system prioritizes the front direction when speech is absent. $C_{no}$ may e.g. be selected as an initial value of $C_x$.

In a similar way, we estimate the elements in the noise covariance matrix, in that case $$\hat{C}_v(m) = \begin{cases} \alpha_v \hat{C}_v(m-1) + (1-\alpha_v)X(m)X(m)^H, \text{Noise only} \\ \hat{C}_v(m-1), \text{Otherwise} \end{cases}; \tag{112}$$

The noise covariance matrix is updated when only noise is present. Whether the target is present or not may be determined by a modulation-based voice activity detector. It should be noted that "Target present" (cf. FIG. 13C) is not necessarily the same as the inverse of "Noise Only". The VAD indicators controlling the update could be derived from different thresholds on momentary SNR or Modulation Index estimates.

Adaptive Smoothing

The performance of look vector estimation is highly dependent on the choice of smoothing factor $\alpha$, which controls the update rate of $\hat{C}_x(m)$. When $\alpha$ is close to zero, an accurate estimate can be obtained in spatially stationary situations. When $\alpha$ is close to 1, estimators will be able to track fast spatial changes, for example when tracking two talkers in a dialogue situation. Ideally, we would like to obtain accurate estimates and fast tracking capabilities which is a contradiction in terms of the smoothing factor and there is a need to find a good balance. In order to simultaneously obtain accurate estimates in spatially stationary situations and fast tracking capabilities, an adaptive smoothing scheme is proposed.

In order to control a variable smoothing factor, the normalized covariance $$\rho(m)=C_{x11}^{-1}C_{x12}, \tag{113}$$

can be observed as an indicator for changes in the target DOA (where $C_{x11}^{-1}$ and $C_{x12}$ are complex numbers).

In a practical implementation, e.g. a portable device, such as hearing aid, we prefer to avoid the division and reduce the number of computations, so we propose the following log normalized covariance measure $$\rho(m)=\Sigma_k\{\log(\max\{0, Im\{\hat{C}_{x12}\}+1\})-\log(\hat{C}_{x11})\}, \tag{114}$$

Two instances of the (log) normalized covariance measure are calculated, a fast instance $\tilde{\rho}(m)$ and an instance $\bar{\rho}(m)$ with variable update rate. The fast instance $\tilde{\rho}(m)$ is based on the fast variance estimate $$\tilde{C}_{x11}(m) = \begin{cases} \tilde{\alpha}\tilde{C}_{x11}(m-1) + (1-\tilde{\alpha})X(m)X(m)^H, \text{Target present} \\ \tilde{C}_{x11}(m-1), \text{Target absent} \end{cases}; \tag{115}$$

where $\tilde{\alpha}$ is a fast time constant smoothing factor, and the corresponding fast covariance estimate $$\tilde{C}_{x12}(m) = \begin{cases} \tilde{\alpha}\tilde{C}_{x12}(m-1) + (1-\tilde{\alpha})X(m)X(m)^H, \text{Target present} \\ \tilde{C}_{x12}(m-1), \text{Target absent} \end{cases}; \tag{116}$$

according to $$\rho(m)=\Sigma_k\{\log(\max\{0, Im\{\tilde{C}_{x12}\}+1\})-\log(\tilde{C}_{x11})\}, \tag{117}$$

Similar expressions for the instance with variable update rate $\bar{\rho}(m)$, based on equivalent estimators $\bar{C}_{x11}(m)$ and $\bar{C}_{x12}(m)$ using a variable smoothing factor $\bar{\alpha}(m)$ can be written:

$$\bar{C}_{x11}(m) = \begin{cases} \bar{\alpha}\bar{C}_{x12}(m-1) + (1-\bar{\alpha})X(m)X(m)^H, \text{Target present} \\ \bar{C}_{x11}(m-1), \text{Target absent} \end{cases}; \tag{115'}$$

where $\tilde{\alpha}$ is a fast time constant smoothing factor, and the corresponding fast covariance estimate $$\bar{C}_{x12}(m) = \begin{cases} \bar{\alpha}\bar{C}_{x12}(m-1) + (1-\bar{\alpha})X(m)X(m)^H, \text{Target present} \\ \bar{C}_{x12}(m-1), \text{Target absent} \end{cases}; \tag{116'}$$

according to $$\rho(m)=\Sigma_k\{\log(\max\{0,Im\{\overline{C}_{x12}\}+1\})-\log(\overline{C}_{x11})\}, \quad (117')$$

The smoothing factor $\overline{\alpha}$ of the variable estimator is changed to fast ($\alpha$) when the normalized covariance measure of the variable estimator deviates too much from the normalized covariance measure of the variable estimator, otherwise the smoothing factor is slow, i.e.

$$\overline{\alpha}(m)=\begin{cases}\alpha_0, & |\tilde{\rho}(m)-\overline{\rho}(m)|\leqq\epsilon\\ \tilde{\alpha}, & |\tilde{\rho}(m)-\overline{\rho}(m)|>\epsilon\end{cases} \quad (118)$$

where $\alpha_0$ is a slow time constant smoothing factor, i.e. $\alpha_0<\overline{\alpha}$, and $\epsilon$ is a constant. Note that the same smoothing factor $\overline{\alpha}(m)$ is used across frequency bands k.

Figure 13A:
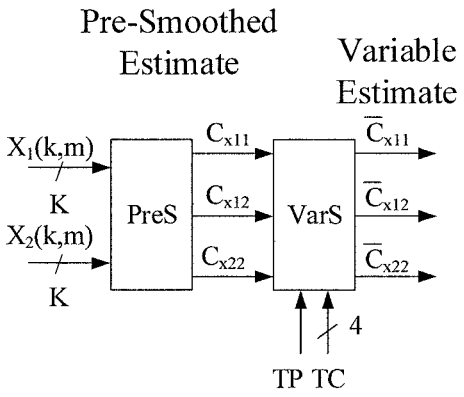
FIGS. 13A, 13B and 13C illustrate a general embodiment of a variable time constant covariance estimator, where FIG. 13A schematically shows a covariance smoothing unit according to the present disclosure, FIG. 13B schematically shows a covariance pre-smoothing unit according to the present disclosure, and FIG. 13C schematically shows a covariance variable smoothing unit according to the present disclosure.
Figure 13B:
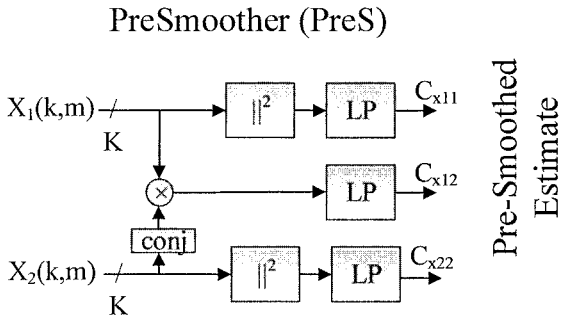
Figure 13C:
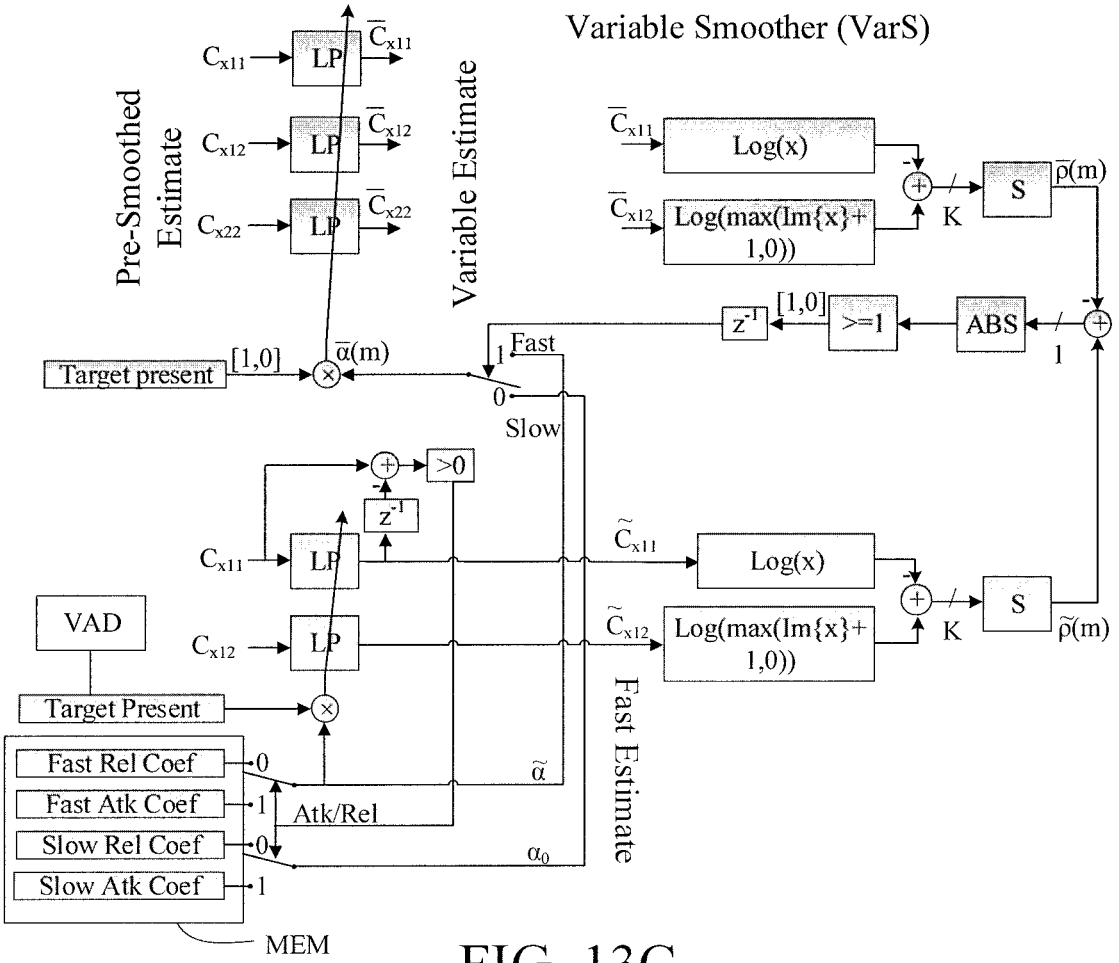

FIGS. 13A, 13B and 13C illustrate a general embodiment of the variable time constant covariance estimator as outlined above.

FIG. 13A schematically shows a covariance smoothing unit according to the present disclosure. The covariance unit comprises a pre-smoothing unit (PreS) and a variable smoothing unit (VarS). The pre-smoothing unit (PreS) makes an initial smoothing over time of instantaneous covariance matrices $C(m)=X(m)X(m)^H$ (e.g. representing the covariance/variance of noisy input signals X) in K frequency bands and provides pre-smoothed covariance matrix estimates $X_{11}$, $X_{12}$ and $X_{22}$ ($<C>_{pre}=<X(M)X(M)^H>$, where <•> indicates LP-smoothing over time). The variable smoothing unit (VarS) makes a variable smoothing of the signals $X_{11}$, $X_{12}$ and $X_{22}$ based on adaptively determined attack and release times in dependence of changes in the acoustic environment as outlined above, and provides smoothed covariance estimators $\overline{C}_{x11}(m)$, $\overline{C}_{x12}(m)$, and $\overline{C}_{x22}(m)$.

The pre-smoothing unit (PreS) makes an initial smoothing over time (illustrated by ABS-squared units $|\bullet|^2$ for providing magnitude squared of the input signals $X_i(k,m)$ and subsequent low-pass filtering provided by low-pass filters LP) to provide pre-smoothed covariance estimates $C_{x11}$, $C_{x12}$ and $C_{x22}$, as illustrated in FIG. 13B. $X_1$ and $X_2$ may e.g. represent first (e.g. front) and second (e.g. rear) (typically noisy) microphone signals of a hearing aid. Elements $C_{x11}$, and $C_{x22}$, represent variances (e.g. variations in amplitude of the input signals), whereas element $C_{x12}$ represent co-variances (e.g. representative of changes in phase (and thus direction) (and amplitude)).

FIG. 13C shows an embodiment of the variable smoothing unit (VarS) providing adaptively smoothed covariance estimators $\overline{C}_{x11}(m)$, $\overline{C}_{x12}(m)$, and $\overline{C}_{x22}(m)$, as discussed above.

The Target Present input is e.g. a control input from a voice activity detector. In an embodiment, the Target Present input (cf. signal TP in FIG. 13A) is a binary estimate (e.g. 1 or 0) of the presence of speech in a given time frame or time segment. In an embodiment, the Target Present input represents a probability of the presence (or absence) of speech in a current input signal (e.g. one of the microphone signals, e.g. $X_1(k,m)$). In the latter case, the Target Present input may take on values in the interval between 0 and 1. The Target Present input may e.g. be an output from a voice activity detector (cf. VAD in FIG. 13C), e.g. as known in the art.

The Fast Rel Coef, the Fast Atk Coref, the Slow Rel Coef, and the Slow Atk Coef are fixed (e.g. determined in advance of the use of the procedure) fast and slow attack and release times, respectively. Generally, fast attack and release times are shorter than slow attack and release times. In an embodiment, the time constants (cf. signals TC in FIG. 13A) are stored in a memory of the hearing aid (cf. e.g. MEM in FIG. 13A). In an embodiment the time constants may be updated during use of the hearing aid.

It should be noted that the goal of the computation of y=log (max(Im{x12}+1,0))−log (x11) (cf. two instances in the right part of FIG. 13C forming part of the determination of the smoothing factor $\overline{\alpha}(m)$) is to detect changes in the acoustical sound scene, e.g. sudden changes in target direction (e.g. due to a switch of current talker in discussion/conversation). The exemplary implementation in FIG. 13C is chosen for its computational simplicity (which is of importance in a hearing device having a limited power budget), as provided by the conversion to a logarithmic domain. A mathematically more correct (but computationally more complex) implementation would be to compute y=x12/x11.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1] D. R. Brillinger, "Time Series: Data Analysis and Theory". Philadelphia: SIAM, 2001.

[2] R. Martin, "Noise Power Spectral Density Estimation Based on Optimal Smoothing and Minimum Statistics," IEEE Trans. Speech, Audio Processing, vol. 9, no. 5, pp. 504-512, July 2001.

[3] U. Kjems and J. Jensen, "Maximum likelihood noise covariance matrix estimation for multi-microphone speech enhancement," in Proc. 20th European Signal Processing Conference (EU-SIPCO), 2012, pp. 295-299.

[4] H. Ye and R. D. DeGroat, "Maximum likelihood doa estimation and asymptotic cramer-rao bounds for additive unknown colored noise," IEEE Trans. Signal Processing, 1995.

[5] J. Jensen and M. S. Pedersen, "Analysis of beamformer directed single-channel noise reduction system for hearing aid applications," in Proc. IEEE Int. Conf. Acoust., Speech, Signal Processing, April 2015, pp. 5728-5732.

[6] K. U. Simmer, J. Bitzer, and C. Marro, "Post-Filtering Techniques," in Microphone Arrays—Signal Processing Techniques and Applications, M. Brandstein and D. Ward, Eds. Springer Verlag, 2001.

EP3300078A1 (Oticon) 28 Mar. 2018

EP3185590A1 (Oticon) 28 Jun. 2017

EP3253075A1 (Oticon) 6 Dec. 2017

The invention claimed is:

1. A microphone system adapted to be worn at an ear of a user, the microphone system comprising a multitude of M of microphones, where M is larger than or equal to two, adapted for picking up sound from the environment and to provide M corresponding electric input signals $x_m(n)$, m=1, . . . , M, n representing time, the environment sound at a given microphone comprising a mixture of a target sound signal $s_m(n)$ propagated via an acoustic propagation channel from a location of a target sound source, and possible additive noise signals $v_m(n)$ as present at the location of the microphone in question;

a signal processor connected to said number of microphones, and being configured to estimate a direction- to and/or a position of the target sound source relative to the microphone system based on a maximum likelihood methodology, and a database Θ comprising a dictionary of vectors $d_\theta$, termed RTF-vectors, whose elements are relative transfer functions $d_m(k)$ representing direction-dependent acoustic transfer functions from said target signal source to each of said M microphones (m=1, . . . , M) relative to a reference microphone (m=i) among said M microphones, k being a frequency index, wherein individual dictionary elements of said database Θ of RTF vectors $d_\theta$ comprises relative transfer functions for a number of different directions (θ) and/or positions (θ, φ, r) relative to the microphone system;

the signal processor is configured to determine a posterior probability or a log (posterior) probability of some of or all of said individual dictionary elements, and determine one or more of the most likely directions to or locations of said target sound source by determining the one or more values among said determined posterior probabilities or said log (posterior) probabilities having the largest posterior probability(ies) or log (posterior) probability(ies), respectively; and said relative transfer functions $d_m(k)$ of the database Θ represent direction-dependent filtering effects of the head and torso of the user in the form of direction-dependent acoustic transfer functions from said target signal source to each of said M microphones (m=1, . . . , M) relative to a reference microphone (m=i) among said M microphones.

2. A microphone system according to claim 1 wherein the signal processor is configured to determine a likelihood function or a log likelihood function of some or all of the elements in the dictionary Θ in dependence of a noisy target signal covariance matrix $C_x$ and a noise covariance matrix $C_v$.

3. A microphone system according to claim 2 wherein said noisy target signal covariance matrix $C_x$ and said noise covariance matrix $C_v$ are estimated and updated based on a voice activity estimate and/or an SNR estimate, e.g. on a frame by frame basis.

4. A microphone system according to claim 2 wherein said noisy target signal covariance matrix $C_x$ and said noise covariance matrix $C_v$ are represented by smoothed estimates.

5. A microphone system according to claim 4 wherein said smoothed estimates of said noisy covariance matrix $\hat{C}_x$ and/or said noise covariance matrix $\hat{C}_v$ are determined by adaptive covariance smoothing.

6. A microphone system according to claim 5 wherein said adaptive covariance smoothing comprises determining normalized fast and variable covariance measures, $\tilde{\rho}(m)$ and an $\tilde{p}(m)$, respectively, of said noisy covariance matrix $\hat{C}_X$ and/or said noise covariance matrix $\hat{C}_V$, applying a fast ($\tilde{\alpha}$) and a variable smoothing factor ($\overline{\alpha}$), respectively, wherein said variable smoothing factor $\overline{\alpha}$ is set to fast ($\tilde{\alpha}$) when the normalized covariance measure of the variable estimator deviates from the normalized covariance measure of the variable estimator by more than a constant value ϵ, and otherwise to slow ($\alpha_0$), i.e.

$$\overline{\alpha}(m) = \begin{cases} \alpha_0, & |\tilde{\rho}(m) - \overline{\rho}(m)| \leqq \epsilon \\ \tilde{\alpha}, & |\tilde{\rho}(m) - \overline{\rho}(m)| > \epsilon \end{cases}$$

where in is a time index, and where $\alpha_0 < \tilde{\alpha}$.

7. A microphone system according to claim 1 wherein the number of microphones M is equal to two, and wherein the signal processor is configured to calculate a log likelihood of at least some of said individual dictionary elements of said database Θ of relative transfer functions $d_m(k)$ for at least one frequency sub-band k, according to the following expression $$\mathcal{L}_{\theta,M=2}(l) \propto -\log\left\{\frac{w_\theta^H(l)\hat{C}_X(l)w_\theta(l)}{w_\theta^H(l)\hat{C}_V(l_0)w_\theta(l)} \times \frac{b_\theta^H\hat{C}_X(l)b_\theta}{b_\theta^H\hat{C}_V(l_0)b_\theta} \times |C_V(l_0)|\right\},$$

where l is a time frame index, $w_\theta$ represents, possibly scaled, MVDR beamformer weights, $\overline{C}_X$ and $\hat{C}_V$ are smoothed estimates of the noisy covariance matrix and the noise covariance matrix, respectively, $b_\theta$ represents beamformer weights of a blocking matrix, and $l_0$ denotes the last frame, where $\tilde{C}_V$, has been updated.

8. A microphone system according to claim 1 wherein the signal processor is configured to estimate the posterior probability or the log (posterior) probability of said individual dictionary elements do of said database Θ comprising relative transfer functions $d_{\theta,m}(k)$, m=1, . . . , M, independently in each frequency band k.

9. A microphone system according to claim 1 wherein the signal processor is configured to estimate the posterior probability or the log (posterior) probability of said individual dictionary elements $d_\theta$ of said database Θ comprising relative transfer functions $d_{\theta,m}(k)$, m=1, . . . , M, jointly across some of or all frequency bands k.

10. A microphone system comprising:

a multitude of M of microphones, where M is larger than or equal to two, adapted for picking up sound from the environment and to provide M corresponding electric input signals $x_m(n)$, m=1, . . . , M, n representing time, the environment sound at a given microphone comprising a mixture of a target sound signal $s_m(n)$ propagated via an acoustic propagation channel from a location of a target sound source, and possible additive noise signals $v_m(n)$ as present at the location of the microphone in question;

a signal processor connected to said number of microphones, and being configured to estimate a direction- to and/or a position of the target sound source relative to the microphone system based on a maximum likelihood methodology;

a database Θ comprising a dictionary of vectors $d_\theta$, termed RTF-vectors, whose elements are relative transfer functions $d_m(k)$ representing direction-dependent acoustic transfer functions from said target signal source to each of said M microphones (m=1, . . . , M) relative to a reference microphone (m=i) among said M microphones, k being a frequency index, wherein individual dictionary elements of said database Θ of RTF vectors $d_\theta$ comprises relative transfer functions for a number of different directions (θ) and/or positions (θ, φ, r) relative to the microphone system; and the signal processor is configured to determine a posterior probability or a log (posterior) probability of some of or all of said individual dictionary elements, and determine one or more of the most likely directions to or locations of said target sound source by determining the one or more values among said determined posterior probabilities or said log (posterior) probabilities having the largest posterior probability(ies) or log (posterior) probability(ies), respectively; and the signal processor is configured to utilize information not derived from said electric input signals to determine one or more of the most likely directions to or locations of said target sound source.

11. A microphone system according to claim 10 wherein said information comprises information about eye gaze, and/or information about head position and/or head movement.

12. A microphone system according to claim 10 wherein said information comprises information stored in the microphone system, or received, e.g. wirelessly received, from another device, e.g. from a sensor, or a microphone, or a cellular telephone, and/or from a user interface.

13. A microphone system according to claim 1 wherein the database Θ of RTF vectors $d_\theta$ comprises an own voice look vector.

14. A hearing device adapted for being won at or in an ear of a user, or for being fully or partially implanted in the head at an ear of the user, the hearing device comprising;

a microphone system comprising a multitude of M of microphones, where M is larger than or equal to two, adapted for picking up sound from the environment and to provide M corresponding electric input signals $x_m(n)$, m=1, . . . , M, n representing time, the environment sound at a given microphone comprising a mixture of a target sound signal $s_m(n)$ propagated via an acoustic propagation channel from a location of a target sound source, and possible additive noise signals $v_m(n)$ as present at the location of the microphone in question;

a signal processor connected to said number of microphones, and being configured to estimate a direction- to and/or a position of the target sound source relative to the microphone system based on a maximum likelihood methodology, and a database Θ comprising a dictionary of vectors $d_\theta$, termed RTF-vectors, whose elements are relative transfer functions $d_m(k)$ representing direction-dependent acoustic transfer functions from said target signal source to each of said M microphones (m=1, . . . , M) relative to a reference microphone (m=i) among said M microphones, k being a frequency index, wherein individual dictionary elements of said database Θ of RTF vectors $d_\theta$ comprises relative transfer functions for a number of different directions (θ) and/or positions (θ, φ, r) relative to the microphone system; and the signal processor is configured to determine a posterior probability or a log (posterior) probability of some of or all of said individual dictionary elements, and determine one or more of the most likely directions to or locations of said target sound source by determining the one or more values among said determined posterior probabilities or said log (posterior) probabilities having the largest posterior probability(ies) or log (posterior) probability(ies), respectively; and a beamformer filtering unit operationally connected to at least some of said multitude of microphones and configured to receive said electric input signals, and configured to provide a beamformed signal in dependence of said one or more of the most likely directions to or locations of said target sound source estimated by said signal processor.

15. A hearing device according to claim 14 wherein said signal processor is configured to smooth said one or more of the most likely directions to or locations of said target sound source before it is used to control the beamformer filtering unit.

16. A hearing device according to claim 15 wherein said signal processor is configured to perform said smoothing over one or more of time, frequency and angular direction.

17. A hearing device according to claim 14 comprising a feedback detector adapted to provide an estimate of a level of feedback in different frequency bands, and wherein said signal processor is configured to weight said posterior probability or log (posterior) probability for frequency bands in dependence of said level of feedback.

18. A hearing device according to claim 14 comprising a hearing aid, a headset, an earphone, an ear protection device or a combination thereof.

19. A method of operating a microphone system comprising a multitude of M of microphones, where M is larger than or equal to two, adapted for picking up sound from the environment, the method comprising:

providing M electric input signals $x_m(n)$, m=1, . . . , M, n representing time, each electric input signal representing the environment sound at a given microphone and comprising a mixture of a target sound signal $s_m(n)$ propagated via an acoustic propagation channel from a location of a target sound source, and possible additive noise signals $v_m(n)$ as present at the location of the microphone in question;

estimating a direction- to and/or a position of the target sound source relative to the microphone system based on said electric input signals;

a maximum likelihood methodology; and a database Θ comprising a dictionary of relative transfer functions $d_m(k)$ representing direction-dependent acoustic transfer functions from each of said M microphones (m=1, . . . , M) to a reference microphone (m=i) among said M microphones, k being a frequency index, wherein the method further comprises providing that individual dictionary elements of said database Θ of relative transfer functions $d_m(k)$ comprises relative transfer functions for a number of different directions (θ) and/or positions (θ, φ, r) relative to the microphone system, where θ, φ, and r are spherical coordinates; and determining a posterior probability or a log (posterior) probability of some of or all of said individual dictionary elements, determining one or more of the most likely directions to or locations of said target sound source by determining the one or more values among said determined posterior probability or said log (posterior) probability having the largest posterior probability (ies) or log (posterior) probability(ies), respectively, and reducing computational complexity in determining one or more of the most likely directions to or locations of said target sound source by one or more of dynamically down sampling, selecting a subset of the number of dictionary elements, selecting a subset of the number of frequency channels, and removing terms in the likelihood function with low importance.

20. A method according to claim 19 wherein the determination of a posterior probability or a log (posterior) probability of some of or all of said individual dictionary elements is performed in two steps, a first step wherein the posterior probability or the log (posterior) probability is evaluated for a first subset of dictionary elements with a first angular resolution in order to obtain a first rough estimation of the most likely directions, and a second step wherein the posterior probability or the log (posterior) probability is evaluated for a second subset of dictionary elements around said first rough estimation of the most likely directions so that dictionary elements around the first rough estimation of the most likely directions are evaluated with second angular resolution, wherein the second angular resolution is larger than the first.

21. A method according to claim 19 comprising a smoothing scheme based on adaptive covariance smoothing.

22. A method according to claim 21 comprising adaptive smoothing of a covariance matrix ($C_x$, $C_v$) for said electric input signals comprising adaptively changing time constants ($\tau_{att}$, $\tau_{rel}$) for said smoothing in dependence of changes (ΔC) over time in covariance of said first and second electric input signals;

wherein said time constants have first values ($\tau_{att1}$, $\tau_{rel1}$) for changes in covariance below a first threshold value ($\Delta C_{th1}$) and second values ($\tau_{att2}$, $\tau_{rel2}$) for changes in covariance above a second threshold value ($\Delta C_{th2}$), wherein the first values are larger than corresponding second values of said time constants, while said first threshold value ($\Delta C_{th1}$) is smaller than or equal to said second threshold value ($\Delta C_{th2}$).

23. A computer program comprising instructions which, when the program is executed by a computer, cause the computer to carry out the method of according to claim 19.

* * * * *